US007975906B2

(12) United States Patent
Schade et al.

(10) Patent No.: US 7,975,906 B2
(45) Date of Patent: Jul. 12, 2011

(54) NUMBERING PROCESS FOR SECURITIES, METHOD FOR PROCESSING THE NUMBERED SECURITIES AND NUMBERING DEVICE TO CARRY OUT THE NUMBERING PROCESS

(75) Inventors: Johannes Georg Schade, Würzburg (DE); Hartmut Karl Sauer, Himmelstadt (DE)

(73) Assignee: KBA-Giori S.A., Lausanne (CH)

( * ) Notice: Subject to any disclaimer, the term of this patent is extended or adjusted under 35 U.S.C. 154(b) by 888 days.

(21) Appl. No.: 11/921,534

(22) PCT Filed: May 24, 2006

(86) PCT No.: PCT/IB2006/051666

§ 371 (c)(1),
(2), (4) Date: Dec. 4, 2007

(87) PCT Pub. No.: WO2006/131839

PCT Pub. Date: Dec. 14, 2006

(65) Prior Publication Data

US 2009/0224029 A1 Sep. 10, 2009

(30) Foreign Application Priority Data

Jun. 8, 2005 (EP) ..... 05405375

(51) Int. Cl.
*G07G 1/00* (2006.01)

(52) U.S. Cl. ..... 235/3; 235/375; 235/379; 283/57; 283/58; 283/59; 283/81

(58) Field of Classification Search ..... 235/3, 375, 235/379; 283/57–59
See application file for complete search history.

(56) References Cited

U.S. PATENT DOCUMENTS 3,120,800 A * 2/1964 Ward ..... 101/72
(Continued)

FOREIGN PATENT DOCUMENTS

DE 2502987 A1 10/1975
(Continued)

*Primary Examiner* — Thien M. Le
*Assistant Examiner* — Tuyen K Vo
(74) *Attorney, Agent, or Firm* — Clifford W. Browning; Krieg DeVault LLP

(57) ABSTRACT

There is described a process for numbering substrates having security prints printed thereon, each of the substrates comprising a plurality of security prints which are arranged in k columns and n rows on the substrate, wherein product k*n is an integer multiple of ten or of twenty-five. The process comprises the step of numbering successive runs of $10^N$ substrates each, by providing each of the security prints with a serial number Serial#, the serial number Serial# being calculated with the formula: $Serial\#=Start\#+\alpha*[(r-1)*k*n*10^N+((i-1)*n+(j-1))*10^N+MOD(s-1;\ 10^N)]$, where Start# is a starting number from which numbering starts, $\alpha$ is equal to −1 or +1 depending on whether numbering is carried out downwards or, respectively upwards, r identifies the run of 10N successive substrates, i and j respectively identify the column and the row on the substrate where the security print to be numbered is located, s is a number which identifies the substrate onto which the security print to be numbered is located and MOD(x; y) designates the so-called modulus function which returns the integer remainder of the division of y by x. Digits N+2 and N+1 of the serial number Serial# are produced by sequential actuation of a double numbering wheel (13, 14) bearing a predetermined sequence of digit pairs for digits N+2 and N+1. Also described are numbering boxes to carry out the numbering process.

13 Claims, 22 Drawing Sheets

U.S. PATENT DOCUMENTS

| | | | | |
|---|---|---|---|---|
| 3,692,298 | A * | 9/1972 | Peacock | 270/12 |
| 6,164,701 | A * | 12/2000 | Murl | 283/57 |
| 6,173,896 | B1 * | 1/2001 | Murl | 235/487 |

FOREIGN PATENT DOCUMENTS

| | | | |
|---|---|---|---|
| DE | 2634221 | A1 | 7/1976 |
| DE | 2847204 | A1 | 10/1978 |
| EP | 0032555 | A1 | 7/1981 |
| EP | 0167196 | A1 | 1/1986 |
| EP | 0598679 | A1 | 10/1993 |
| EP | 0718112 | A1 | 9/1995 |
| WO | WO 2004/016433 | A1 | 8/2003 |
| WO | WO 2005/018945 | A1 | 3/2005 |

* cited by examiner

Sheet 1 (Layer 1)

| | A | B | C | D | E |
|---|---|---|---|---|---|
| 10 | X'0'999'100 | X'0'998'100 | X'0'997'100 | X'0'996'100 | X'0'995'100 |
| 9 | X'0'999'200 | X'0'998'200 | X'0'997'200 | X'0'996'200 | X'0'995'200 |
| 8 | X'0'999'300 | X'0'998'300 | X'0'997'300 | X'0'996'300 | X'0'995'300 |
| 7 | X'0'999'400 | X'0'998'400 | X'0'997'400 | X'0'996'400 | X'0'995'400 |
| 6 | X'0'999'500 | X'0'998'500 | X'0'997'500 | X'0'996'500 | X'0'995'500 |
| 5 | X'0'999'600 | X'0'998'600 | X'0'997'600 | X'0'996'600 | X'0'995'600 |
| 4 | X'0'999'700 | X'0'998'700 | X'0'997'700 | X'0'996'700 | X'0'995'700 |
| 3 | X'0'999'800 | X'0'998'800 | X'0'997'800 | X'0'996'800 | X'0'995'800 |
| 2 | X'0'999'900 | X'0'998'900 | X'0'997'900 | X'0'996'900 | X'0'995'900 |
| 1 | X'1'000'000 | X'0'999'000 | X'0'998'000 | X'0'997'000 | X'0'996'000 |

Fig. 1A
Prior Art

Sheet 2 (Layer 1)

| | A | B | C | D | E |
|---|---|---|---|---|---|
| 10 | X'0'999'099 | X'0'998'099 | X'0'997'099 | X'0'996'099 | X'0'995'099 |
| 9 | X'0'999'199 | X'0'998'199 | X'0'997'199 | X'0'996'199 | X'0'995'199 |
| 8 | X'0'999'299 | X'0'998'299 | X'0'997'299 | X'0'996'299 | X'0'995'299 |
| 7 | X'0'999'399 | X'0'998'399 | X'0'997'399 | X'0'996'399 | X'0'995'399 |
| 6 | X'0'999'499 | X'0'998'499 | X'0'997'499 | X'0'996'499 | X'0'995'499 |
| 5 | X'0'999'599 | X'0'998'599 | X'0'997'599 | X'0'996'599 | X'0'995'599 |
| 4 | X'0'999'699 | X'0'998'699 | X'0'997'699 | X'0'996'699 | X'0'995'699 |
| 3 | X'0'999'799 | X'0'998'799 | X'0'997'799 | X'0'996'799 | X'0'995'799 |
| 2 | X'0'999'899 | X'0'998'899 | X'0'997'899 | X'0'996'899 | X'0'995'899 |
| 1 | X'0'999'999 | X'0'998'999 | X'0'997'999 | X'0'996'999 | X'0'995'999 |

Fig. 1B
Prior Art

Sheet 100 (Layer 1)

| | A | B | C | D | E |
|---|---|---|---|---|---|
| 10 | X'0'999'001 | X'0'998'001 | X'0'997'001 | X'0'996'001 | X'0'995'001 |
| 9 | X'0'999'101 | X'0'998'101 | X'0'997'101 | X'0'996'101 | X'0'995'101 |
| 8 | X'0'999'201 | X'0'998'201 | X'0'997'201 | X'0'996'201 | X'0'995'201 |
| 7 | X'0'999'301 | X'0'998'301 | X'0'997'301 | X'0'996'301 | X'0'995'301 |
| 6 | X'0'999'401 | X'0'998'401 | X'0'997'401 | X'0'996'401 | X'0'995'401 |
| 5 | X'0'999'501 | X'0'998'501 | X'0'997'501 | X'0'996'501 | X'0'995'501 |
| 4 | X'0'999'601 | X'0'998'601 | X'0'997'601 | X'0'996'601 | X'0'995'601 |
| 3 | X'0'999'701 | X'0'998'701 | X'0'997'701 | X'0'996'701 | X'0'995'701 |
| 2 | X'0'999'801 | X'0'998'801 | X'0'997'801 | X'0'996'801 | X'0'995'801 |
| 1 | X'0'999'901 | X'0'998'901 | X'0'997'901 | X'0'996'901 | X'0'995'901 |

Fig. 1C
Prior Art

Sheet 101 (Layer 2)

| | A | B | C | D | E |
|---|---|---|---|---|---|
| 10 | X'0'994'100 | X'0'993'100 | X'0'992'100 | X'0'991'100 | X'0'990'100 |
| 9 | X'0'994'200 | X'0'993'200 | X'0'992'200 | X'0'991'200 | X'0'990'200 |
| 8 | X'0'994'300 | X'0'993'300 | X'0'992'300 | X'0'991'300 | X'0'990'300 |
| 7 | X'0'994'400 | X'0'993'400 | X'0'992'400 | X'0'991'400 | X'0'990'400 |
| 6 | X'0'994'500 | X'0'993'500 | X'0'992'500 | X'0'991'500 | X'0'990'500 |
| 5 | X'0'994'600 | X'0'993'600 | X'0'992'600 | X'0'991'600 | X'0'990'600 |
| 4 | X'0'994'700 | X'0'993'700 | X'0'992'700 | X'0'991'700 | X'0'990'700 |
| 3 | X'0'994'800 | X'0'993'800 | X'0'992'800 | X'0'991'800 | X'0'990'800 |
| 2 | X'0'994'900 | X'0'993'900 | X'0'992'900 | X'0'991'900 | X'0'990'900 |
| 1 | X'0'995'000 | X'0'994'000 | X'0'993'000 | X'0'992'000 | X'0'991'000 |

Fig. 1D
Prior Art

Sheet 102 (Layer 2)

| | A | B | C | D | E |
|---|---|---|---|---|---|
| 10 | X'0'994'099 | X'0'993'099 | X'0'992'099 | X'0'991'099 | X'0'990'099 |
| 9 | X'0'994'199 | X'0'993'199 | X'0'992'199 | X'0'991'199 | X'0'990'199 |
| 8 | X'0'994'299 | X'0'993'299 | X'0'992'299 | X'0'991'299 | X'0'990'299 |
| 7 | X'0'994'399 | X'0'993'399 | X'0'992'399 | X'0'991'399 | X'0'990'399 |
| 6 | X'0'994'499 | X'0'993'499 | X'0'992'499 | X'0'991'499 | X'0'990'499 |
| 5 | X'0'994'599 | X'0'993'599 | X'0'992'599 | X'0'991'599 | X'0'990'599 |
| 4 | X'0'994'699 | X'0'993'699 | X'0'992'699 | X'0'991'699 | X'0'990'699 |
| 3 | X'0'994'799 | X'0'993'799 | X'0'992'799 | X'0'991'799 | X'0'990'799 |
| 2 | X'0'994'899 | X'0'993'899 | X'0'992'899 | X'0'991'899 | X'0'990'899 |
| 1 | X'0'994'999 | X'0'993'999 | X'0'992'999 | X'0'991'999 | X'0'990'999 |

Fig. 1E
Prior Art

Sheet 200 (Layer 2)

| | A | B | C | D | E |
|---|---|---|---|---|---|
| 10 | X'0'994'001 | X'0'993'001 | X'0'992'001 | X'0'991'001 | X'0'990'001 |
| 9 | X'0'994'101 | X'0'993'101 | X'0'992'101 | X'0'991'101 | X'0'990'101 |
| 8 | X'0'994'201 | X'0'993'201 | X'0'992'201 | X'0'991'201 | X'0'990'201 |
| 7 | X'0'994'301 | X'0'993'301 | X'0'992'301 | X'0'991'301 | X'0'990'301 |
| 6 | X'0'994'401 | X'0'993'401 | X'0'992'401 | X'0'991'401 | X'0'990'401 |
| 5 | X'0'994'501 | X'0'993'501 | X'0'992'501 | X'0'991'501 | X'0'990'501 |
| 4 | X'0'994'601 | X'0'993'601 | X'0'992'601 | X'0'991'601 | X'0'990'601 |
| 3 | X'0'994'701 | X'0'993'701 | X'0'992'701 | X'0'991'701 | X'0'990'701 |
| 2 | X'0'994'801 | X'0'993'801 | X'0'992'801 | X'0'991'801 | X'0'990'801 |
| 1 | X'0'994'901 | X'0'993'901 | X'0'992'901 | X'0'991'901 | X'0'990'901 |

Fig. 1F
Prior Art

Sheet 201 (Layer 3)

| | A | B | C | D | E |
|---|---|---|---|---|---|
| 10 | X'0'989'100 | X'0'988'100 | X'0'987'100 | X'0'986'100 | X'0'985'100 |
| 9 | X'0'989'200 | X'0'988'200 | X'0'987'200 | X'0'986'200 | X'0'985'200 |
| 8 | X'0'989'300 | X'0'988'300 | X'0'987'300 | X'0'986'300 | X'0'985'300 |
| 7 | X'0'989'400 | X'0'988'400 | X'0'987'400 | X'0'986'400 | X'0'985'400 |
| 6 | X'0'989'500 | X'0'988'500 | X'0'987'500 | X'0'986'500 | X'0'985'500 |
| 5 | X'0'989'600 | X'0'988'600 | X'0'987'600 | X'0'986'600 | X'0'985'600 |
| 4 | X'0'989'700 | X'0'988'700 | X'0'987'700 | X'0'986'700 | X'0'985'700 |
| 3 | X'0'989'800 | X'0'988'800 | X'0'987'800 | X'0'986'800 | X'0'985'800 |
| 2 | X'0'989'900 | X'0'988'900 | X'0'987'900 | X'0'986'900 | X'0'985'900 |
| 1 | X'0'990'000 | X'0'989'000 | X'0'988'000 | X'0'987'000 | X'0'986'000 |

Fig. 1G
Prior Art

Sheet 202 (Layer 3)

| | A | B | C | D | E |
|---|---|---|---|---|---|
| 10 | X'0'989'099 | X'0'988'099 | X'0'987'099 | X'0'986'099 | X'0'985'099 |
| 9 | X'0'989'199 | X'0'988'199 | X'0'987'199 | X'0'986'199 | X'0'985'199 |
| 8 | X'0'989'299 | X'0'988'299 | X'0'987'299 | X'0'986'299 | X'0'985'299 |
| 7 | X'0'989'399 | X'0'988'399 | X'0'987'399 | X'0'986'399 | X'0'985'399 |
| 6 | X'0'989'499 | X'0'988'499 | X'0'987'499 | X'0'986'499 | X'0'985'499 |
| 5 | X'0'989'599 | X'0'988'599 | X'0'987'599 | X'0'986'599 | X'0'985'599 |
| 4 | X'0'989'699 | X'0'988'699 | X'0'987'699 | X'0'986'699 | X'0'985'699 |
| 3 | X'0'989'799 | X'0'988'799 | X'0'987'799 | X'0'986'799 | X'0'985'799 |
| 2 | X'0'989'899 | X'0'988'899 | X'0'987'899 | X'0'986'899 | X'0'985'899 |
| 1 | X'0'989'999 | X'0'988'999 | X'0'987'999 | X'0'986'999 | X'0'985'999 |

Fig. 1H
Prior Art

Layer 1 pile (sheets 1 to 100)

| | A | B | C | D | E |
|---|---|---|---|---|---|
| 10 | X'0'999'001 ...<br>X'0'999'100 | X'0'998'001 ...<br>X'0'998'100 | X'0'997'001 ...<br>X'0'997'100 | X'0'996'001 ...<br>X'0'996'100 | X'0'995'001 ...<br>X'0'995'100 |
| 9 | X'0'999'101 ...<br>X'0'999'200 | X'0'998'101 ...<br>X'0'998'200 | X'0'997'101 ...<br>X'0'997'200 | X'0'996'101 ...<br>X'0'996'200 | X'0'995'101 ...<br>X'0'995'200 |
| 8 | X'0'999'201 ...<br>X'0'999'300 | X'0'998'201 ...<br>X'0'998'300 | X'0'997'201 ...<br>X'0'997'300 | X'0'996'201 ...<br>X'0'996'300 | X'0'995'201 ...<br>X'0'995'300 |
| 7 | X'0'999'301 ...<br>X'0'999'400 | X'0'998'301 ...<br>X'0'998'400 | X'0'997'301 ...<br>X'0'997'400 | X'0'996'301 ...<br>X'0'996'400 | X'0'995'301 ...<br>X'0'995'400 |
| 6 | X'0'999'401 ...<br>X'0'999'500 | X'0'998'401 ...<br>X'0'998'500 | X'0'997'401 ...<br>X'0'997'500 | X'0'996'401 ...<br>X'0'996'500 | X'0'995'401 ...<br>X'0'995'500 |
| 5 | X'0'999'501 ...<br>X'0'999'600 | X'0'998'501 ...<br>X'0'998'600 | X'0'997'501 ...<br>X'0'997'600 | X'0'996'501 ...<br>X'0'996'600 | X'0'995'501 ...<br>X'0'995'600 |
| 4 | X'0'999'601 ...<br>X'0'999'700 | X'0'998'601 ...<br>X'0'998'700 | X'0'997'601 ...<br>X'0'997'700 | X'0'996'601 ...<br>X'0'996'700 | X'0'995'601 ...<br>X'0'995'700 |
| 3 | X'0'999'701 ...<br>X'0'999'800 | X'0'998'701 ...<br>X'0'998'800 | X'0'997'701 ...<br>X'0'997'800 | X'0'996'701 ...<br>X'0'996'800 | X'0'995'701 ...<br>X'0'995'800 |
| 2 | X'0'999'801 ...<br>X'0'999'900 | X'0'998'801 ...<br>X'0'998'900 | X'0'997'801 ...<br>X'0'997'900 | X'0'996'801 ...<br>X'0'996'900 | X'0'995'801 ...<br>X'0'995'900 |
| 1 | X'0'999'901 ...<br>X'1'000'000 | X'0'998'901 ...<br>X'0'999'000 | X'0'997'901 ...<br>X'0'998'000 | X'0'996'901 ...<br>X'0'997'000 | X'0'995'901 ...<br>X'0'996'000 |

Fig. 2A
Prior Art

Layer 2 pile (sheets 101 to 200)

| | A | B | C | D | E |
|---|---|---|---|---|---|
| 10 | X'0'994'001 ...<br>X'0'994'100 | X'0'993'001 ...<br>X'0'993'100 | X'0'992'001 ...<br>X'0'992'100 | X'0'991'001 ...<br>X'0'991'100 | X'0'990'001 ...<br>X'0'990'100 |
| 9 | X'0'994'101 ...<br>X'0'994'200 | X'0'993'101 ...<br>X'0'993'200 | X'0'992'101 ...<br>X'0'992'200 | X'0'991'101 ...<br>X'0'991'200 | X'0'990'101 ...<br>X'0'990'200 |
| 8 | X'0'994'201 ...<br>X'0'994'300 | X'0'993'201 ...<br>X'0'993'300 | X'0'992'201 ...<br>X'0'992'300 | X'0'991'201 ...<br>X'0'991'300 | X'0'990'201 ...<br>X'0'990'300 |
| 7 | X'0'994'301 ...<br>X'0'994'400 | X'0'993'301 ...<br>X'0'993'400 | X'0'992'301 ...<br>X'0'992'400 | X'0'991'301 ...<br>X'0'991'400 | X'0'990'301 ...<br>X'0'990'400 |
| 6 | X'0'994'401 ...<br>X'0'994'500 | X'0'993'401 ...<br>X'0'993'500 | X'0'992'401 ...<br>X'0'992'500 | X'0'991'401 ...<br>X'0'991'500 | X'0'990'401 ...<br>X'0'990'500 |
| 5 | X'0'994'501 ...<br>X'0'994'600 | X'0'993'501 ...<br>X'0'993'600 | X'0'992'501 ...<br>X'0'992'600 | X'0'991'501 ...<br>X'0'991'600 | X'0'990'501 ...<br>X'0'990'600 |
| 4 | X'0'994'601 ...<br>X'0'994'700 | X'0'993'601 ...<br>X'0'993'700 | X'0'992'601 ...<br>X'0'992'700 | X'0'991'601 ...<br>X'0'991'700 | X'0'990'601 ...<br>X'0'990'700 |
| 3 | X'0'994'701 ...<br>X'0'994'800 | X'0'993'701 ...<br>X'0'993'800 | X'0'992'701 ...<br>X'0'992'800 | X'0'991'701 ...<br>X'0'991'800 | X'0'990'701 ...<br>X'0'990'800 |
| 2 | X'0'994'801 ...<br>X'0'994'900 | X'0'993'801 ...<br>X'0'993'900 | X'0'992'801 ...<br>X'0'992'900 | X'0'991'801 ...<br>X'0'991'900 | X'0'990'801 ...<br>X'0'990'900 |
| 1 | X'0'994'901 ...<br>X'0'995'000 | X'0'993'901 ...<br>X'0'994'000 | X'0'992'901 ...<br>X'0'993'000 | X'0'991'901 ...<br>X'0'992'000 | X'0'990'901 ...<br>X'0'991'000 |

Fig. 2B
Prior Art

Layer 3 pile (sheets 201 to 300)

| | A | B | C | D | E |
|---|---|---|---|---|---|
| 10 | X'0'989'001 ...<br>X'0'989'100 | X'0'988'001 ...<br>X'0'988'100 | X'0'987'001 ...<br>X'0'987'100 | X'0'986'001 ...<br>X'0'986'100 | X'0'985'001 ...<br>X'0'985'100 |
| 9 | X'0'989'101 ...<br>X'0'989'200 | X'0'988'101 ...<br>X'0'988'200 | X'0'987'101 ...<br>X'0'987'200 | X'0'986'101 ...<br>X'0'986'200 | X'0'985'101 ...<br>X'0'985'200 |
| 8 | X'0'989'201 ...<br>X'0'989'300 | X'0'988'201 ...<br>X'0'988'300 | X'0'987'201 ...<br>X'0'987'300 | X'0'986'201 ...<br>X'0'986'300 | X'0'985'201 ...<br>X'0'985'300 |
| 7 | X'0'989'301 ...<br>X'0'989'400 | X'0'988'301 ...<br>X'0'988'400 | X'0'987'301 ...<br>X'0'987'400 | X'0'986'301 ...<br>X'0'986'400 | X'0'985'301 ...<br>X'0'985'400 |
| 6 | X'0'989'401 ...<br>X'0'989'500 | X'0'988'401 ...<br>X'0'988'500 | X'0'987'401 ...<br>X'0'987'500 | X'0'986'401 ...<br>X'0'986'500 | X'0'985'401 ...<br>X'0'985'500 |
| 5 | X'0'989'501 ...<br>X'0'989'600 | X'0'988'501 ...<br>X'0'988'600 | X'0'987'501 ...<br>X'0'987'600 | X'0'986'501 ...<br>X'0'986'600 | X'0'985'501 ...<br>X'0'985'600 |
| 4 | X'0'989'601 ...<br>X'0'989'700 | X'0'988'601 ...<br>X'0'988'700 | X'0'987'601 ...<br>X'0'987'700 | X'0'986'601 ...<br>X'0'986'700 | X'0'985'601 ...<br>X'0'985'700 |
| 3 | X'0'989'701 ...<br>X'0'989'800 | X'0'988'701 ...<br>X'0'988'800 | X'0'987'701 ...<br>X'0'987'800 | X'0'986'701 ...<br>X'0'986'800 | X'0'985'701 ...<br>X'0'985'800 |
| 2 | X'0'989'801 ...<br>X'0'989'900 | X'0'988'801 ...<br>X'0'988'900 | X'0'987'801 ...<br>X'0'987'900 | X'0'986'801 ...<br>X'0'986'900 | X'0'985'801 ...<br>X'0'985'900 |
| 1 | X'0'989'901 ...<br>X'0'990'000 | X'0'988'901 ...<br>X'0'989'000 | X'0'987'901 ...<br>X'0'988'000 | X'0'986'901 ...<br>X'0'987'000 | X'0'985'901 ...<br>X'0'986'000 |

Fig. 2C
Prior Art

| Digits 5 ¦ 4 ¦ 3 | | | | | | |
|---|---|---|---|---|---|---|
| Sheets: | 1 | 2-100 | 101 | 102-200 | 201 | 202-300 |
| Layers. | 1 | | 2 | | 3 | |
| A1 | 0 0¦0 | 9 9¦9 | 9 5¦0 | 9 4¦9 | 9 0¦0 | 8 9¦9 |
| A2 | 9 9¦9 | 9 9¦8 | 9 4¦9 | 9 4¦8 | 8 9¦9 | 8 9¦8 |
| A3 | 9 9¦8 | 9 9¦7 | 9 4¦8 | 9 4¦7 | 8 9¦8 | 8 9¦7 |
| A4 | 9 9¦7 | 9 9¦6 | 9 4¦7 | 9 4¦6 | 8 9¦7 | 8 9¦6 |
| A5 | 9 9¦6 | 9 9¦5 | 9 4¦6 | 9 4¦5 | 8 9¦6 | 8 9¦5 |
| A6 | 9 9¦5 | 9 9¦4 | 9 4¦5 | 9 4¦4 | 8 9¦5 | 8 9¦4 |
| A7 | 9 9¦4 | 9 9¦3 | 9 4¦4 | 9 4¦3 | 8 9¦4 | 8 9¦3 |
| A8 | 9 9¦3 | 9 9¦2 | 9 4¦3 | 9 4¦2 | 8 9¦3 | 8 9¦2 |
| A9 | 9 9¦2 | 9 9¦1 | 9 4¦2 | 9 4¦1 | 8 9¦2 | 8 9¦1 |
| A10 | 9 9¦1 | 9 9¦0 | 9 4¦1 | 9 4¦0 | 8 9¦1 | 8 9¦0 |
| B1 | 9 9¦0 | 9 8¦9 | 9 4¦0 | 9 3¦9 | 8 9¦0 | 8 8¦9 |
| B2 | 9 8¦9 | 9 8¦8 | 9 3¦9 | 9 3¦8 | 8 8¦9 | 8 8¦8 |
| B3 | 9 8¦8 | 9 8¦7 | 9 3¦8 | 9 3¦7 | 8 8¦8 | 8 8¦7 |
| B4 | 9 8¦7 | 9 8¦6 | 9 3¦7 | 9 3¦6 | 8 8¦7 | 8 8¦6 |
| B5 | 9 8¦6 | 9 8¦5 | 9 3¦6 | 9 3¦5 | 8 8¦6 | 8 8¦5 |
| B6 | 9 8¦5 | 9 8¦4 | 9 3¦5 | 9 3¦4 | 8 8¦5 | 8 8¦4 |
| B7 | 9 8¦4 | 9 8¦3 | 9 3¦4 | 9 3¦3 | 8 8¦4 | 8 8¦3 |
| B8 | 9 8¦3 | 9 8¦2 | 9 3¦3 | 9 3¦2 | 8 8¦3 | 8 8¦2 |
| B9 | 9 8¦2 | 9 8¦1 | 9 3¦2 | 9 3¦1 | 8 8¦2 | 8 8¦1 |
| B10 | 9 8¦1 | 9 8¦0 | 9 3¦1 | 9 3¦0 | 8 8¦1 | 8 8¦0 |
| C1 | 9 8¦0 | 9 7¦9 | 9 3¦0 | 9 2¦9 | 8 8¦0 | 8 7¦9 |
| C2 | 9 7¦9 | 9 7¦8 | 9 2¦9 | 9 2¦8 | 8 7¦9 | 8 7¦8 |
| C3 | 9 7¦8 | 9 7¦7 | 9 2¦8 | 9 2¦7 | 8 7¦8 | 8 7¦7 |
| C4 | 9 7¦7 | 9 7¦6 | 9 2¦7 | 9 2¦6 | 8 7¦7 | 8 7¦6 |
| C5 | 9 7¦6 | 9 7¦5 | 9 2¦6 | 9 2¦5 | 8 7¦6 | 8 7¦5 |
| C6 | 9 7¦5 | 9 7¦4 | 9 2¦5 | 9 2¦4 | 8 7¦5 | 8 7¦4 |
| C7 | 9 7¦4 | 9 7¦3 | 9 2¦4 | 9 2¦3 | 8 7¦4 | 8 7¦3 |
| C8 | 9 7¦3 | 9 7¦2 | 9 2¦3 | 9 2¦2 | 8 7¦3 | 8 7¦2 |
| C9 | 9 7¦2 | 9 7¦1 | 9 2¦2 | 9 2¦1 | 8 7¦2 | 8 7¦1 |
| C10 | 9 7¦1 | 9 7¦0 | 9 2¦1 | 9 2¦0 | 8 7¦1 | 8 7¦0 |
| D1 | 9 7¦0 | 9 6¦9 | 9 2¦0 | 9 1¦9 | 8 7¦0 | 8 6¦9 |
| D2 | 9 6¦9 | 9 6¦8 | 9 1¦9 | 9 1¦8 | 8 6¦9 | 8 6¦8 |
| D3 | 9 6¦8 | 9 6¦7 | 9 1¦8 | 9 1¦7 | 8 6¦8 | 8 6¦7 |
| D4 | 9 6¦7 | 9 6¦6 | 9 1¦7 | 9 1¦6 | 8 6¦7 | 8 6¦6 |
| D5 | 9 6¦6 | 9 6¦5 | 9 1¦6 | 9 1¦5 | 8 6¦6 | 8 6¦5 |
| D6 | 9 6¦5 | 9 6¦4 | 9 1¦5 | 9 1¦4 | 8 6¦5 | 8 6¦4 |
| D7 | 9 6¦4 | 9 6¦3 | 9 1¦4 | 9 1¦3 | 8 6¦4 | 8 6¦3 |
| D8 | 9 6¦3 | 9 6¦2 | 9 1¦3 | 9 1¦2 | 8 6¦3 | 8 6¦2 |
| D9 | 9 6¦2 | 9 6¦1 | 9 1¦2 | 9 1¦1 | 8 6¦2 | 8 6¦1 |
| D10 | 9 6¦1 | 9 6¦0 | 9 1¦1 | 9 1¦0 | 8 6¦1 | 8 6¦0 |
| E1 | 9 6¦0 | 9 5¦9 | 9 1¦0 | 9 0¦9 | 8 6¦0 | 8 5¦9 |
| E2 | 9 5¦9 | 9 5¦8 | 9 0¦9 | 9 0¦8 | 8 5¦9 | 8 5¦8 |
| E3 | 9 5¦8 | 9 5¦7 | 9 0¦8 | 9 0¦7 | 8 5¦8 | 8 5¦7 |
| E4 | 9 5¦7 | 9 5¦6 | 9 0¦7 | 9 0¦6 | 8 5¦7 | 8 5¦6 |
| E5 | 9 5¦6 | 9 5¦5 | 9 0¦6 | 9 0¦5 | 8 5¦6 | 8 5¦5 |
| E6 | 9 5¦5 | 9 5¦4 | 9 0¦5 | 9 0¦4 | 8 5¦5 | 8 5¦4 |
| E7 | 9 5¦4 | 9 5¦3 | 9 0¦4 | 9 0¦3 | 8 5¦4 | 8 5¦3 |
| E8 | 9 5¦3 | 9 5¦2 | 9 0¦3 | 9 0¦2 | 8 5¦3 | 8 5¦2 |
| E9 | 9 5¦2 | 9 5¦1 | 9 0¦2 | 9 0¦1 | 8 5¦2 | 8 5¦1 |
| E10 | 9 5¦1 | 9 5¦0 | 9 0¦1 | 9 0¦0 | 8 5¦1 | 8 5¦0 |

Fig. 3

Sheet 1 (Layer 1)

| | A | B | C | D | E |
|---|---|---|---|---|---|
| 8 | X'0'999'300 | X'0'998'500 | X'0'997'700 | X'0'996'900 | X'0'996'100 |
| 7 | X'0'999'400 | X'0'998'600 | X'0'997'800 | X'0'997'000 | X'0'996'200 |
| 6 | X'0'999'500 | X'0'998'700 | X'0'997'900 | X'0'997'100 | X'0'996'300 |
| 5 | X'0'999'600 | X'0'998'800 | X'0'998'000 | X'0'997'200 | X'0'996'400 |
| 4 | X'0'999'700 | X'0'998'900 | X'0'998'100 | X'0'997'300 | X'0'996'500 |
| 3 | X'0'999'800 | X'0'999'000 | X'0'998'200 | X'0'997'400 | X'0'996'600 |
| 2 | X'0'999'900 | X'0'999'100 | X'0'998'300 | X'0'997'500 | X'0'996'700 |
| 1 | X'1'000'000 | X'0'999'200 | X'0'998'400 | X'0'997'600 | X'0'996'800 |

Fig. 4A

Sheet 101 (Layer 2)

| | A | B | C | D | E |
|---|---|---|---|---|---|
| 8 | X'0'995'300 | X'0'994'500 | X'0'993'700 | X'0'992'900 | X'0'992'100 |
| 7 | X'0'995'400 | X'0'994'600 | X'0'993'800 | X'0'993'000 | X'0'992'200 |
| 6 | X'0'995'500 | X'0'994'700 | X'0'993'900 | X'0'993'100 | X'0'992'300 |
| 5 | X'0'995'600 | X'0'994'800 | X'0'994'000 | X'0'993'200 | X'0'992'400 |
| 4 | X'0'995'700 | X'0'994'900 | X'0'994'100 | X'0'993'300 | X'0'992'500 |
| 3 | X'0'995'800 | X'0'995'000 | X'0'994'200 | X'0'993'400 | X'0'992'600 |
| 2 | X'0'995'900 | X'0'995'100 | X'0'994'300 | X'0'993'500 | X'0'992'700 |
| 1 | X'0'996'000 | X'0'995'200 | X'0'994'400 | X'0'993'600 | X'0'992'800 |

Fig. 4B

Digits 5 | 4 | 3

| Sheets: | 1 | 2-100 | 101 | 102-200 | 201 | 202-300 | 301 | 302-400 | 401 | 402-600 | 601 | 602-606 |
|---|---|---|---|---|---|---|---|---|---|---|---|---|
| Layers: | 1 | | 2 | | 3 | | 4 | | 5 | | 6 | |
| A1 | 0 0\|0 | 9 9\|9 | 9 6\|0 | 9 5\|9 | 9 2\|0 | 9 1\|9 | 8 8\|0 | 8 7\|9 | 8 4\|0 | 8 3\|9 | 8 0\|0 | 7 9\|9 |
| A2 | 9 9\|9 | 9 9\|8 | 9 6\|9 | 9 5\|8 | 9 1\|9 | 9 1\|8 | 8 7\|9 | 8 7\|8 | 8 3\|9 | 8 3\|8 | 7 9\|9 | 7 9\|8 |
| A3 | 9 9\|8 | 9 9\|7 | 9 5\|8 | 9 5\|7 | 9 1\|8 | 9 1\|7 | 8 7\|8 | 8 7\|7 | 8 3\|8 | 8 3\|7 | 7 9\|8 | 7 9\|7 |
| A4 | 9 9\|7 | 9 9\|6 | 9 5\|7 | 9 5\|6 | 9 1\|7 | 9 1\|6 | 8 7\|7 | 8 7\|6 | 8 3\|7 | 8 3\|6 | 7 9\|7 | 7 9\|6 |
| A5 | 9 9\|6 | 9 9\|5 | 9 5\|6 | 9 5\|5 | 9 1\|6 | 9 1\|5 | 8 7\|6 | 8 7\|5 | 8 3\|6 | 8 3\|5 | 7 9\|6 | 7 9\|5 |
| A6 | 9 9\|5 | 9 9\|4 | 9 5\|5 | 9 5\|4 | 9 1\|5 | 9 1\|4 | 8 7\|5 | 8 7\|4 | 8 3\|5 | 8 3\|4 | 7 9\|5 | 7 9\|4 |
| A7 | 9 9\|4 | 9 9\|3 | 9 5\|4 | 9 5\|3 | 9 1\|4 | 9 1\|3 | 8 7\|4 | 8 7\|3 | 8 3\|4 | 8 3\|3 | 7 9\|4 | 7 9\|3 |
| A8 | 9 9\|3 | 9 9\|2 | 9 5\|3 | 9 5\|2 | 9 1\|3 | 9 1\|2 | 8 7\|3 | 8 7\|2 | 8 3\|3 | 8 3\|2 | 7 9\|3 | 7 9\|2 |
| B1 | 9 9\|2 | 9 9\|1 | 9 5\|2 | 9 5\|1 | 9 1\|2 | 9 1\|1 | 8 7\|2 | 8 7\|1 | 8 3\|2 | 8 3\|1 | 7 9\|2 | 7 9\|1 |
| B2 | 9 9\|1 | 9 9\|0 | 9 5\|1 | 9 5\|0 | 9 1\|1 | 9 1\|0 | 8 7\|1 | 8 7\|0 | 8 3\|1 | 8 3\|0 | 7 9\|1 | 7 9\|0 |
| B3 | 9 9\|0 | 9 8\|9 | 9 5\|0 | 9 4\|9 | 9 1\|0 | 9 0\|9 | 8 7\|0 | 8 6\|9 | 8 3\|0 | 8 2\|9 | 7 9\|0 | 7 8\|9 |
| B4 | 9 8\|9 | 9 8\|8 | 9 4\|9 | 9 4\|8 | 9 0\|9 | 9 0\|8 | 8 6\|9 | 8 6\|8 | 8 2\|9 | 8 2\|8 | 7 9\|9 | 7 8\|8 |
| B5 | 9 8\|8 | 9 8\|7 | 9 4\|8 | 9 4\|7 | 9 0\|8 | 9 0\|7 | 8 6\|8 | 8 6\|7 | 8 2\|8 | 8 2\|7 | 7 8\|8 | 7 8\|7 |
| B6 | 9 8\|7 | 9 8\|6 | 9 4\|7 | 9 4\|6 | 9 0\|7 | 9 0\|6 | 8 6\|7 | 8 6\|6 | 8 2\|7 | 8 2\|6 | 7 8\|7 | 7 8\|6 |
| B7 | 9 8\|6 | 9 8\|5 | 9 4\|6 | 9 4\|5 | 9 0\|6 | 9 0\|5 | 8 6\|6 | 8 6\|5 | 8 2\|6 | 8 2\|5 | 7 8\|6 | 7 8\|5 |
| B8 | 9 8\|5 | 9 8\|4 | 9 4\|5 | 9 4\|4 | 9 0\|5 | 9 0\|4 | 8 6\|5 | 8 6\|4 | 8 2\|5 | 8 2\|4 | 7 8\|5 | 7 8\|4 |
| C1 | 9 8\|4 | 9 8\|3 | 9 4\|4 | 9 4\|3 | 9 0\|4 | 9 0\|3 | 8 6\|4 | 8 6\|3 | 8 2\|4 | 8 2\|3 | 7 8\|4 | 7 8\|3 |
| C2 | 9 8\|3 | 9 8\|2 | 9 4\|3 | 9 4\|2 | 9 0\|3 | 9 0\|2 | 8 6\|3 | 8 6\|2 | 8 2\|3 | 8 2\|2 | 7 8\|3 | 7 8\|2 |
| C3 | 9 8\|2 | 9 8\|1 | 9 4\|2 | 9 4\|1 | 9 0\|2 | 9 0\|1 | 8 6\|2 | 8 6\|1 | 8 2\|2 | 8 2\|1 | 7 8\|2 | 7 8\|1 |
| C4 | 9 8\|1 | 9 8\|0 | 9 4\|1 | 9 4\|0 | 9 0\|1 | 9 0\|0 | 8 6\|1 | 8 6\|0 | 8 2\|1 | 8 2\|0 | 7 8\|1 | 7 8\|0 |
| C5 | 9 8\|0 | 9 7\|9 | 9 4\|0 | 9 3\|9 | 9 0\|0 | 8 9\|9 | 8 6\|0 | 8 5\|9 | 8 2\|0 | 8 1\|9 | 7 8\|0 | 7 7\|9 |
| C6 | 9 7\|9 | 9 7\|8 | 9 3\|9 | 9 3\|8 | 8 9\|9 | 8 9\|8 | 8 5\|9 | 8 5\|8 | 8 1\|9 | 8 1\|8 | 7 7\|9 | 7 7\|8 |
| C7 | 9 7\|8 | 9 7\|7 | 9 3\|8 | 9 3\|7 | 8 9\|8 | 8 9\|7 | 8 5\|8 | 8 5\|7 | 8 1\|8 | 8 1\|7 | 7 7\|8 | 7 7\|7 |
| C8 | 9 7\|7 | 9 7\|6 | 9 3\|7 | 9 3\|6 | 8 9\|7 | 8 9\|6 | 8 5\|7 | 8 5\|6 | 8 1\|7 | 8 1\|6 | 7 7\|7 | 7 7\|6 |
| D1 | 9 7\|6 | 9 7\|5 | 9 3\|6 | 9 3\|5 | 8 9\|6 | 8 9\|5 | 8 5\|6 | 8 5\|5 | 8 1\|6 | 8 1\|5 | 7 7\|6 | 7 7\|5 |
| D2 | 9 7\|5 | 9 7\|4 | 9 3\|5 | 9 3\|4 | 8 9\|5 | 8 9\|4 | 8 5\|5 | 8 5\|4 | 8 1\|5 | 8 1\|4 | 7 7\|5 | 7 7\|4 |
| D3 | 9 7\|4 | 9 7\|3 | 9 3\|4 | 9 3\|3 | 8 9\|4 | 8 9\|3 | 8 5\|4 | 8 5\|3 | 8 1\|4 | 8 1\|3 | 7 7\|4 | 7 7\|3 |
| D4 | 9 7\|3 | 9 7\|2 | 9 3\|3 | 9 3\|2 | 8 9\|3 | 8 9\|2 | 8 5\|3 | 8 5\|2 | 8 1\|3 | 8 1\|2 | 7 7\|3 | 7 7\|2 |
| D5 | 9 7\|2 | 9 7\|1 | 9 3\|2 | 9 3\|1 | 8 9\|2 | 8 9\|1 | 8 5\|2 | 8 5\|1 | 8 1\|2 | 8 1\|1 | 7 7\|2 | 7 7\|1 |
| D6 | 9 7\|1 | 9 7\|0 | 9 3\|1 | 9 3\|0 | 8 9\|1 | 8 9\|0 | 8 5\|1 | 8 5\|0 | 8 1\|1 | 8 1\|0 | 7 7\|1 | 7 7\|0 |
| D7 | 9 7\|0 | 9 6\|9 | 9 3\|0 | 9 2\|9 | 8 9\|0 | 8 8\|9 | 8 5\|0 | 8 4\|9 | 8 1\|0 | 8 0\|9 | 7 7\|0 | 7 6\|9 |
| D8 | 9 6\|9 | 9 6\|8 | 9 2\|9 | 9 2\|8 | 8 8\|9 | 8 8\|8 | 8 4\|9 | 8 4\|8 | 8 0\|9 | 8 0\|8 | 7 6\|9 | 7 6\|8 |
| E1 | 9 6\|8 | 9 6\|7 | 9 2\|8 | 9 2\|7 | 8 8\|8 | 8 8\|7 | 8 4\|8 | 8 4\|7 | 8 0\|8 | 8 0\|7 | 7 6\|8 | 7 6\|7 |
| E2 | 9 6\|7 | 9 6\|6 | 9 2\|7 | 9 2\|6 | 8 8\|7 | 8 8\|6 | 8 4\|7 | 8 4\|6 | 8 0\|7 | 8 0\|6 | 7 6\|7 | 7 6\|6 |
| E3 | 9 6\|6 | 9 6\|5 | 9 2\|6 | 9 2\|5 | 8 8\|6 | 8 8\|5 | 8 4\|6 | 8 4\|5 | 8 0\|6 | 8 0\|5 | 7 6\|6 | 7 6\|5 |
| F4 | 9 6\|5 | 9 6\|4 | 9 2\|5 | 9 2\|4 | 8 8\|5 | 8 8\|4 | 8 4\|5 | 8 4\|4 | 8 0\|5 | 8 0\|4 | 7 6\|5 | 7 6\|4 |
| E5 | 9 6\|4 | 9 6\|3 | 9 2\|4 | 9 2\|3 | 8 8\|4 | 8 8\|3 | 8 4\|4 | 8 4\|3 | 8 0\|4 | 8 0\|3 | 7 6\|4 | 7 6\|3 |
| F6 | 9 6\|3 | 9 6\|2 | 9 2\|3 | 9 2\|2 | 8 8\|3 | 8 8\|2 | 8 4\|3 | 8 4\|2 | 8 0\|3 | 8 0\|2 | 7 6\|3 | 7 6\|2 |
| E7 | 9 6\|2 | 9 6\|1 | 9 2\|2 | 9 2\|1 | 8 8\|2 | 8 8\|1 | 8 4\|2 | 8 4\|1 | 8 0\|2 | 8 0\|1 | 7 6\|2 | 7 6\|1 |
| E8 | 9 6\|1 | 9 6\|0 | 9 2\|1 | 9 2\|0 | 8 8\|1 | 8 8\|0 | 8 4\|1 | 8 4\|0 | 8 0\|1 | 8 0\|0 | 7 6\|1 | 7 6\|0 |

Fig. 5

Sheet 1 (Layer 1)

| | A | B | C | D | E |
|---|---|---|---|---|---|
| 5 | X'0'999'600 | X'0'999'100 | X'0'998'600 | X'0'998'100 | X'0'997'600 |
| 4 | X'0'999'700 | X'0'999'200 | X'0'998'700 | X'0'998'200 | X'0'997'700 |
| 3 | X'0'999'800 | X'0'999'300 | X'0'998'800 | X'0'998'300 | X'0'997'800 |
| 2 | X'0'999'900 | X'0'999'400 | X'0'998'900 | X'0'998'400 | X'0'997'900 |
| 1 | X'1'000'000 | X'0'999'500 | X'0'999'000 | X'0'998'500 | X'0'998'000 |

Fig. 6A

Sheet 101 (Layer 2)

| | A | B | C | D | E |
|---|---|---|---|---|---|
| 5 | X'0'997'100 | X'0'996'600 | X'0'996'100 | X'0'995'600 | X'0'995'100 |
| 4 | X'0'997'200 | X'0'996'700 | X'0'996'200 | X'0'995'700 | X'0'995'200 |
| 3 | X'0'997'300 | X'0'996'800 | X'0'996'300 | X'0'995'800 | X'0'995'300 |
| 2 | X'0'997'400 | X'0'996'900 | X'0'996'400 | X'0'995'900 | X'0'995'400 |
| 1 | X'0'997'500 | X'0'997'000 | X'0'996'500 | X'0'996'000 | X'0'995'500 |

Fig. 6B

Digits 5 | 4 | 3

| Sheets: | 1 | 2-100 | 101 | 102-200 | 201 | 202-300 | 301 | 302-400 | 401 | 402-500 |
|---|---|---|---|---|---|---|---|---|---|---|
| Layers: | 1 | | 2 | | 3 | | 4 | | 5 | |
| A1 | 0 0\|0 | 9 9\|9 | 9 7\|5 | 9 7\|4 | 9 5\|0 | 9 4\|9 | 9 2\|5 | 9 2\|4 | 9 0\|0 | 8 9\|9 |
| A2 | 9 9\|9 | 9 9\|8 | 9 7\|4 | 9 7\|3 | 9 4\|9 | 9 4\|8 | 9 2\|4 | 9 2\|3 | 8 9\|9 | 8 9\|8 |
| A3 | 9 9\|8 | 9 9\|7 | 9 7\|3 | 9 7\|2 | 9 4\|8 | 9 4\|7 | 9 2\|3 | 9 2\|2 | 8 9\|8 | 8 9\|7 |
| A4 | 9 9\|7 | 9 9\|6 | 9 7\|2 | 9 7\|1 | 9 4\|7 | 9 4\|6 | 9 2\|2 | 9 2\|1 | 8 9\|7 | 8 9\|6 |
| A5 | 9 9\|6 | 9 9\|5 | 9 7\|1 | 9 7\|0 | 9 4\|6 | 9 4\|5 | 9 2\|1 | 9 2\|0 | 8 9\|6 | 8 9\|5 |
| B1 | 9 9\|5 | 9 9\|4 | 9 7\|0 | 9 6\|9 | 9 4\|5 | 9 4\|4 | 9 2\|0 | 9 1\|9 | 8 9\|5 | 8 9\|4 |
| B2 | 9 9\|4 | 9 9\|3 | 9 6\|9 | 9 6\|8 | 9 4\|4 | 9 4\|3 | 9 1\|9 | 9 1\|8 | 8 9\|4 | 8 9\|3 |
| B3 | 9 9\|3 | 9 9\|2 | 9 6\|8 | 9 6\|7 | 9 4\|3 | 9 4\|2 | 9 1\|8 | 9 1\|7 | 8 9\|3 | 8 9\|2 |
| B4 | 9 9\|2 | 9 9\|1 | 9 6\|7 | 9 6\|6 | 9 4\|2 | 9 4\|1 | 9 1\|7 | 9 1\|6 | 8 9\|2 | 8 9\|1 |
| B5 | 9 9\|1 | 9 9\|0 | 9 6\|6 | 9 6\|5 | 9 4\|1 | 9 4\|0 | 9 1\|6 | 9 1\|5 | 8 9\|1 | 8 9\|0 |
| C1 | 9 9\|0 | 9 8\|9 | 9 6\|5 | 9 6\|4 | 9 4\|0 | 9 3\|9 | 9 1\|5 | 9 1\|4 | 8 9\|0 | 8 8\|9 |
| C2 | 9 8\|9 | 9 8\|8 | 9 6\|4 | 9 6\|3 | 9 3\|9 | 9 3\|8 | 9 1\|4 | 9 1\|3 | 8 8\|9 | 8 8\|8 |
| C3 | 9 8\|8 | 9 8\|7 | 9 6\|3 | 9 6\|2 | 9 3\|8 | 9 3\|7 | 9 1\|3 | 9 1\|2 | 8 8\|8 | 8 8\|7 |
| C4 | 9 8\|7 | 9 8\|6 | 9 6\|2 | 9 6\|1 | 9 3\|7 | 9 3\|6 | 9 1\|2 | 9 1\|1 | 8 8\|7 | 8 8\|6 |
| C5 | 9 8\|6 | 9 8\|5 | 9 6\|1 | 9 6\|0 | 9 3\|6 | 9 3\|5 | 9 1\|1 | 9 1\|0 | 8 8\|6 | 8 8\|5 |
| D1 | 9 8\|5 | 9 8\|4 | 9 6\|0 | 9 5\|9 | 9 3\|5 | 9 3\|4 | 9 1\|0 | 9 0\|9 | 8 8\|5 | 8 8\|4 |
| D2 | 9 8\|4 | 9 8\|3 | 9 5\|9 | 9 5\|8 | 9 3\|4 | 9 3\|3 | 9 0\|9 | 9 0\|8 | 8 8\|4 | 8 8\|3 |
| D3 | 9 8\|3 | 9 8\|2 | 9 5\|8 | 9 5\|7 | 9 3\|3 | 9 3\|2 | 9 0\|8 | 9 0\|7 | 8 8\|3 | 8 8\|2 |
| D4 | 9 8\|2 | 9 8\|1 | 9 5\|7 | 9 5\|6 | 9 3\|2 | 9 3\|1 | 9 0\|7 | 9 0\|6 | 8 8\|2 | 8 8\|1 |
| D5 | 9 8\|1 | 9 8\|0 | 9 5\|6 | 9 5\|5 | 9 3\|1 | 9 3\|0 | 9 0\|6 | 9 0\|5 | 8 8\|1 | 8 8\|0 |
| E1 | 9 8\|0 | 9 7\|9 | 9 5\|5 | 9 5\|4 | 9 3\|0 | 9 2\|9 | 9 0\|5 | 9 0\|4 | 8 8\|0 | 8 7\|9 |
| E2 | 9 7\|9 | 9 7\|8 | 9 5\|4 | 9 5\|3 | 9 2\|9 | 9 2\|8 | 9 0\|4 | 9 0\|3 | 8 7\|9 | 8 7\|8 |
| E3 | 9 7\|8 | 9 7\|7 | 9 5\|3 | 9 5\|2 | 9 2\|8 | 9 2\|7 | 9 0\|3 | 9 0\|2 | 8 7\|8 | 8 7\|7 |
| E4 | 9 7\|7 | 9 7\|6 | 9 5\|2 | 9 5\|1 | 9 2\|7 | 9 2\|6 | 9 0\|2 | 9 0\|1 | 8 7\|7 | 8 7\|6 |
| E5 | 9 7\|6 | 9 7\|5 | 9 5\|1 | 9 5\|0 | 9 2\|6 | 9 2\|5 | 9 0\|1 | 9 0\|0 | 8 7\|6 | 8 7\|5 |

Fig. 7

NUMBERING PROCESS FOR SECURITIES, METHOD FOR PROCESSING THE NUMBERED SECURITIES AND NUMBERING DEVICE TO CARRY OUT THE NUMBERING PROCESS

This application claims the benefits under 35 U.S.C. 119 (a)-(d) or (b), or 365(b) of International Application No. PCT/IB2006/051666 filed May 24, 2006, and European Patent Application No. 05405375.6 filed Jun. 8, 2005.

TECHNICAL FIELD

The present invention generally relates to a process for numbering substrates used for the production of securities, such as banknotes, checks, identification or travel documents and the like, each of the substrates comprising a plurality of security prints which are arranged in columns and rows. The present invention also relates to a method for processing substrates numbered according to this numbering process. The present invention further relates to a numbering device, or numbering box, adapted to carry out the numbering process.

BACKGROUND OF THE INVENTION

In the art of security printing, in particular the printing of banknotes or similar printed securities, the printed documents are commonly numbered at the end of the printing process, each document receiving a unique combination of alphanumeric characters and/or symbols which builds the so-called serial number of the security document.

Numbering is commonly performed at a stage of the printing and processing process where the sheets or webs onto which the securities are printed have not yet been cut into individual security documents. At this stage, security prints which are ultimately intended to form the security documents are arranged on the substrate in columns and rows, forming an array with a predetermined number of security prints. These printed substrates, which can either take the form of individual sheets or repetitive lengths of a continuous web, are passed through a numbering machine where the serial numbers are applied to each security print on the substrate. Numbering processes and devices for carrying out these numbering processes are for instance disclosed in German Patent DE 25 02 987 (corresponding to U.S. Pat. No. 3,939,621 and U.S. Pat. No. 4,045,944), German Patent DE 26 34 221 (corresponding to U.S. Pat. No. 4,072,100), European Patent EP 0 167 196, European Patent EP 0 598 679 or WO 2004/016433. Examples of so-called numbering boxes to carry out the numbering process are disclosed for instance in German Patent DE 30 47 390, EP Patent EP 0 718 112, WO 2004/016433 or WO 2005/018945.

DE 26 34 221 (see also U.S. Pat. No. 4,072,100) discloses a numbering machine comprising at least two identical numbering boxes which are operated in a simultaneous manner. Means are provided to ensure that the serial numbers formed by the said at least two numbering boxes are the same. Each numbering box comprises a set of individual numbering wheels that can be actuated separately, i.e. one numbering wheel per digit of the serial number.

After the numbering process, the numbered substrates are commonly processed in a machine where piles of numbered substrates are firstly cut into bundles of individual security documents (each security document bearing a corresponding one of the numbered security prints). These bundles are then commonly banded and assembled to form packs of security documents. Substrates carrying banknotes, for instance, are usually processed by piles of hundred sheets each, each pile being cut into bundles of hundred banknotes which are then processed to form packs of ten bundles, each pack thus consisting of a total of one thousand individual banknotes. The processing of numbered substrates to form packs of bundles of security documents as summarized hereabove is for instance disclosed in German Patent DE 25 02 987 or European Patent EP 0 167 196.

It is sometimes desirable to process the numbered substrates into individual packs of security documents numbered in sequence. This task not only requires that the various security prints lying in the same position on the substrate within a given pile be numbered in sequence so that each bundle cut out of this pile includes consecutively-numbered security documents, but more critically requires that the cut bundles be collated in an adequate manner so as to build a complete series of security documents without interruption of the sequence of serial numbers throughout the assembled pack of bundles. This previously required a relative complex collecting system as disclosed in German Patent DE 25 02 987.

A solution to the problem of collating of security documents so as to form packs numbered in sequence has been proposed in European patent EP 0 598 679. Thanks to this numbering process, it is possible to assemble packs comprising ten bundles of hundred security documents each, with the serial numbers of the thousand security documents following each other in sequence. A disadvantage of the numbering process proposed in EP 0 598 679 however resides in the fact that the next series of thousand documents which receives the complete sequence of serial numbers that directly follows the serials numbers of a given series of thousand documents is derived from the following pile of sheets. In other words, should one desire to build a pack containing more than one thousand security documents numbered in sequence, this requires processing of at least two successive pile and accumulation of the corresponding bundles and packs until the desired number of security documents numbered in sequence is attained. As a matter of fact, with this prior art numbering process, M successive piles (i.e. M×100 substrates) is required in order to be able to build packs with M thousand security documents numbered in sequence.

An improved numbering process has thus been proposed in international application WO 2004/016433 which is incorporated herein by reference as regards the proposed numbering process. According to this numbering process, each of the security prints within a given pile (or layer) of $10^N$ sheets are numbered in such a way that a single pile yields, after processing of the pile, k*n bundles of $10^N$ security documents which are numbered in sequence (k and n respectively designating the number of columns and rows of security prints per substrate). With this improved numbering process, collating of the bundles is greatly simplified and does not require temporary storage of the bundles between successive piles, the bundles being simply collected and assembled one after the other. For example, a pile of hundred sheets carrying five columns and ten rows of security prints will yield a complete sequence of five thousand security documents numbered in sequence (or fifty bundles of hundred security documents) which can directly be assembled into packs without this requiring processing of a subsequent pile.

The numbering process disclosed in WO 2004/016433 can be summarized as follows: for substrates comprising a plurality of security prints which are arranged in k columns and n rows, successive runs (also referred to as "layers") of $10^N$ substrates each are numbered by providing each of the security prints with a serial number Serial#, the serial number Serial# being calculated with the formula:

$$\text{Serial\#}=\text{Start\#}+\alpha*[(r-1)*k*n*10^N+((i-1)*n+(j-1))*10^N+\text{MOD}(s-1;10^N)],$$

where Start# is a starting number from which numbering starts, $\alpha$ is equal to −1 or +1 depending on whether numbering is carried out downwards or, respectively upwards, r identifies the run or layer of $10^N$ successive substrates, i and j respectively identify the column and the row on the substrate where the security print to be numbered is located, and s is a number which identifies the substrate onto which the security print to be numbered is located.

In the above formula, function MOD(x; y) designates the so-called modulus function which returns the integer remainder of the division of y by x. In the above formula, function MOD(s−1; $10^N$) will thus return an integer number between 0 and $10^N-1$.

FIGS. 1A to 1H are tables which illustrate the numbering principle of WO 2004/016433 as applied to sheets carrying an array of five columns (k=5) and ten rows (n=10) of security prints, the sheets being numbered by successive runs, or layers, of hundred sheets (N=2). More precisely, FIGS. 1A to 1H respectively illustrate the serial numbers applied onto the security prints of the s=$1^{st}$, $2^{nd}$, $100^{th}$, $101^{st}$, $102^{nd}$, $200^{th}$, $201^{st}$ and $202^{nd}$ sheets to be numbered. For the sake of illustration, it is assumed in this example that numbering is carried out downwards ($\alpha$=−1) from a starting number Start# equal to "X,1,000,000", symbol "X" designating one or more additional prefixes which can be manually set by the operator but which are not as such automatically actuated during the numbering process. In FIGS. 1A to 1H, the five columns are designated by letters A to E and are each attributed a corresponding column number i which ranges in this case from i=1 for column A to i=k=5 for column E. Similarly, each row is identified by a corresponding row number j which ranges in this case from j=1 to j=n=10. The position of each security print on the sheet may accordingly be designated by the combination of the letter designating the column number and of the row number where the security print is located.

Referring to FIGS. 1A to 1C, it will be understood that sheets 1, 2 and 100 belong to a same layer, namely the first layer composed of the first hundred sheets which are numbered. On the other hand, sheets 101, 102 and 200 which are illustrated in FIGS. 1D to 1F all belong to the second layer of hundred sheets (i.e. sheets 101 to 200), while sheets 201 and 202 which are illustrated in FIGS. 1G and 1H both belong to the third layer of hundred sheets (i.e. sheets 201 to 300). Each sheet that follows is numbered in a similar manner until the last sheet that can be numbered for the closed set of serial numbers in consideration, i.e. until the 1,000,000/50=20,000$^{th}$ sheet in this example.

FIGS. 2A to 2C illustrate on the other hand successive piles obtained from the piling of the first, second and third layers of hundred sheets after numbering has been performed. Each sheet within a given layer of hundred sheets will receive serial numbers in such a manner that, for each position, the following sheet in the same layer will bear a serial number that is decremented by one unit. Referring for instance to FIG. 2A which schematically represents the piling of the sheets of the first layer (i.e. a pile composed of sheets 1 to 100 disposed in sequence on top of the other), each position in the pile will include a series of hundred security prints that are numbered in sequence. More importantly, the serial number that directly follows the last serial number of one position will be the starting serial number of a subsequent position in the pile.

The path indicated by arrows in FIG. 2A which goes from position A1 to A10, continues from position B1 to B10, then from position C1 to C10, and so on until position E10, indicates the path to follow to ensure that the sequence of serial numbers remains uninterrupted. This path also represents the path that is followed when collating the various bundles to form packs of bundles numbered in sequence.

A complete sequence of serial numbers is present in each and every single layer of hundred documents. As illustrated in FIG. 2A, the first layer of hundred sheets (sheets 1 to 100) will cover a complete and uninterrupted sequence of k*n*$10^N$=5,000 prints with serial numbers ranging from "X,0,995,001" to "X,1,000,000". The layer that directly follows (i.e. the second layer comprising sheets 101 to 200) will, as illustrated in FIG. 2B, cover the following uninterrupted sequence of 5,000 prints with serial numbers ranging from "X,0,990,001" to "X,0,995,000". The same of course applies for each subsequent layer, as for example illustrated in FIG. 2C which schematically shows a piled composed of the sheets of the third layer (sheets 201 to 300).

Thanks to the numbering principle of WO 2004/016433, each layer of $10^N$ sheets with k*n security prints numbered in sequence will yield k*n bundles numbered in sequence and that can directly and easily be assembled to form packs of security documents without interruption of the sequence of serial numbers. A considerable advantage of this numbering principle reside in the fact that it allows to build packs of any desired size, since the numbering sequence remains uninterrupted not only within a given layer but also over a whole succession of layers. Collating of bundles in sequence can be achieved without any great difficulty at all as this process does not requires the temporary storage of bundles. The bundles of a given layer merely need to be processed in sequence along the path schematically illustrated in FIG. 2A.

A numbering box specifically designed to carry out the above numbering process is further disclosed in WO 2004/016433. This numbering box can be considered as an hybrid numbering box as it combines purely sequentially-actuated numbering wheels and independently-actuated numbering wheels. For instance, in case of numbering successive runs, or layers, of hundred substrates (N=2) with less than hundred security prints per substrate (k*n<100), the numbering wheels for the units and tenths of the serial number (i.e. digits 1 to N=2) are sequentially-actuated numbering wheels, which can be constructed as typical mechanical numbering wheels, and the numbering wheels for the hundredths and thousandths (i.e. digits 3 and 4) are independently-actuated numbering wheels. All subsequent numbering wheels (i.e. for digit 5, 6, 7 . . . )—except the prefix wheels—are again actuated in a sequential manner, mechanically, electromechanically or by any other appropriate means.

The individual actuation of the numbering wheels for the hundredths and thousandths is necessary in order to allow skipping to any appropriate number and ensure non-interruption of the numbering sequence, the amount of skipping depending on the substrate layout, in particular the number k*n of security prints per substrate. Referring for instance to FIGS. 1C and 1D, one can see that the serial numbers change from the $100^{th}$ sheet to the $101^{st}$ sheet by a determined amount. For numbering location A1 for example, the serial number must change from "X,0,999,901" on the $100^{th}$ sheet to "X,0,995,000" on the $101^{st}$ sheet, i.e. digit 4 of the serial number must skip from "9" to "5" while digit 3 must skip from "9" to "0".

One disadvantage of the numbering box of WO 2004/016433 resides in the fact that its manufacturing costs are substantially higher than those of purely mechanical numbering boxes. On the other hand, typical mechanical numbering boxes wherein all numbering wheels bear the sequence of ten numerals "0" to "9" are not adapted to carry out the above numbering process as skipping of each numbering wheels can only occur in a purely sequential manner, preventing in particular the thousandths and hundredths numbering wheels from skipping to the appropriate numbers from one run to the next.

With some limitations as regards the substrate layout, it is however possible to design purely mechanical numbering boxes to carry out the numbering process of WO 2004/016433. International application WO 2005/018945, which is incorporated herein by reference in its entirety, for instance discloses numbering boxes which are adapted to carry out the numbering process of WO 2004/016433 on successive runs of hundred successive substrates each bearing a number k*n of security prints which is an integer multiple of ten. More precisely, the disclosed numbering boxes are specifically adapted to apply serial numbers composed of six digits (plus three additional prefixes) on substrates carrying twenty, forty or fifty security prints.

The numbering boxes of WO 2005/018945 are generally similar to conventional mechanical numbering boxes and still comprise individual ten-segment numbering wheels for each digit of the serial number which are actuated in a sequential manner. One of the particularities of these numbering boxes however resides in the fact that each box has a specific numbering configuration which is different for each numbering location. More precisely, each numbering box comprises a different and specific combination of numbering wheels for the hundredths (digit 3) and thousandths (digit 4), which only bear the required numerals for the corresponding numbering location. For the sake of simplicity, a detailed description of the numbering box configurations of WO 2005/018945 will not be repeated here.

One disadvantage of the numbering boxes of WO 2005/018945 may be seen in the fact that digits 4 and 3 composing the serial numbers are generated by two numbering wheels, as with conventional mechanical numbering wheels, an appropriate actuation mechanism being required in order to ensure that the adequate sequence for digits 3 and 4 is generated for each sheet. If one of these two numbering wheels experiences a skipping error, the correct sequence of digits will be lost. With the numbering boxes of WO 2005/018945, the corrective operation required to recover from this skipping error is made quite complex, particularly due to the fact that the same numerals are repeated several times on the hundredths and thousandths numbering wheels, which prevents the operators from readily understanding where the skipping error occurred.

Another disadvantage of the numbering boxes of WO 2005/018945 resides in the fact that different ratchet/cam profiles are required for the hundredths and thousandths numbering wheels depending on the numbering location, as for example illustrate in FIG. 2 of WO 2005/018945. This requirement negatively affects the manufacturing costs of the numbering boxes.

SUMMARY OF THE INVENTION

It is therefore a general aim of the present invention to provide an improved numbering process and numbering box. In particular, an aim is to propose a numbering box configuration that is reliable, easy to operate and cost-effective to manufacture.

These aims are achieved by the objects of the annexed independent claims.

In particular, a first object of the present invention is a process for numbering substrates having security prints printed thereon, the features of which are listed in claim 1.

According to the invention, each substrate comprises a plurality of security prints which are arranged in k columns and n rows on the substrate, product k*n being an integer multiple of ten or of twenty-five. The numbering process comprises the step of numbering successive runs of $10^N$ substrates each, by providing each of the security prints with a serial number Serial#, the serial number Serial# being calculated with the formula:

$$\text{Serial\#}=\text{Start\#}+\alpha*[(r-1)*k*n*10^N+((i-1)*n+(j-1))*10^N+\text{MOD}(s-1;10^N)],$$

where Start# is a starting number from which numbering starts, $\alpha$ is equal to −1 or +1 depending on whether numbering is carried out downwards or, respectively upwards, r identifies the run of $10^N$ successive substrates, i and j respectively identify the column and the row on the substrate where the security print to be numbered is located, and s is a number which identifies the substrate onto which the security print to be numbered is located. According to the invention, digits N+2 and N+1 of the serial number are produced by sequential actuation of a double numbering wheel bearing a predetermined sequence of digit pairs for digits N+2 and N+1.

A second object of the present invention is a method for processing substrates in the form of sheets or repetitive lengths of webs, each of the substrates including security prints arranged in k columns and n rows, wherein product k*n is an integer multiple of ten or twenty-five, the method comprising the following steps:

- numbering successive runs of $10^N$ substrates each, according to the above numbering process;
- piling the successively numbered substrates of each run so as to form successive piles of $10^N$ substrates numbered in sequence;
- processing the piles to form P packs of individual security documents numbered in sequence, each individual security document bearing one security print.

Still another object of the present invention is a numbering box for typographic numbering of substrates in sheet-fed or web-fed printing machines, each of the substrates including security prints arranged in k columns and n rows, product k*n being an integer multiple of ten or of twenty-five, wherein the numbering box is adapted to apply serial numbers Serial# comprising d digits onto a determined location on each substrate, the serial number being given by the following formula:

$$\text{Serial\#}=\text{Start\#}+\alpha*[(r-1)*k*n*10^N+((i-1)*n+(j-1))*10^N+\text{MOD}(s-1;10^N)],$$

where Start# is a starting number from which numbering starts, $\alpha$ is equal to −1 or +1 depending on whether numbering is carried out downwards or, respectively upwards, r identifies a run of $10^N$ successive substrates, i and j respectively identify the column and the row on the substrate where the security print to be numbered is located, and s is a number which identifies the substrate onto which the security print to be numbered is located. This numbering box includes d−1 numbering wheels, namely N numbering wheels for digits 1 to N, a double numbering wheel for digits N+2 and N+1 which bears a predetermined sequence of digit pairs, and d−N−2 numbering wheels for digits N+3 to d.

According to the invention, rather than generating the two digits N+2 and N+1 by separate actuation of two distinct numbering wheels, these digits are generated by a single numbering wheel bearing the required sequence of digit pairs.

This notably reduced the problems of setting of the numbering wheels to the appropriate positions, in particular in case of a skipping error. In addition, as this will be appreciated hereinafter, the numbering boxes may use a common ratchet/cam configuration for all numbering locations.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which:

FIGS. 1A to 1H are schematic illustrations of sheets with fifty security prints each, arranged in five columns and ten rows which are numbered according to the numbering process of the present invention, FIGS. 1A to 1H representing respectively the $1^{st}$, $2^{nd}$, $100^{th}$, $101^{st}$, $102^{nd}$, $200^{th}$, $201^{st}$ and $202^{nd}$ numbered sheets;

FIGS. 2A to 2C are schematic illustrations of successive piles of hundred sheets obtained after the first three numbering runs of sheets;

FIG. 3 is a table summarizing, for each position A1 to E10 on a sheet with fifty security prints as illustrated in FIG. 1A, the evolution of digits 5, 4 and 3 of the serial numbers that appear on successively-numbered sheets;

FIGS. 4A and 4B are schematic illustrations of sheets with forty security prints arranged in five columns and eight rows which are numbered according to the numbering process of the present invention, FIGS. 4A and 4B representing respectively the $1^{st}$ and $101^{st}$ numbered sheets;

FIG. 5 is a table summarizing, for each position A1 to D10 on a sheet with forty security prints as illustrated in FIGS. 4A and 4B, the evolution of digits 5, 4 and 3 of the serial numbers that appear on successively-numbered sheets;

FIGS. 6A and 6B are schematic illustrations of sheets with twenty-five security prints arranged in five columns and five rows which are numbered according to the numbering process of the present invention, FIGS. 6A and 6B representing respectively the $1^{st}$ and $101^{st}$ numbered sheets;

FIG. 7 is a table summarizing, for each position A1 to E5 on a sheet with twenty-five security prints as illustrated in FIGS. 6A and 6B, the evolution of digits 5, 4 and 3 of the serial numbers that appear on successively-numbered sheets;

EMBODIMENTS OF THE INVENTION

Figure 8:
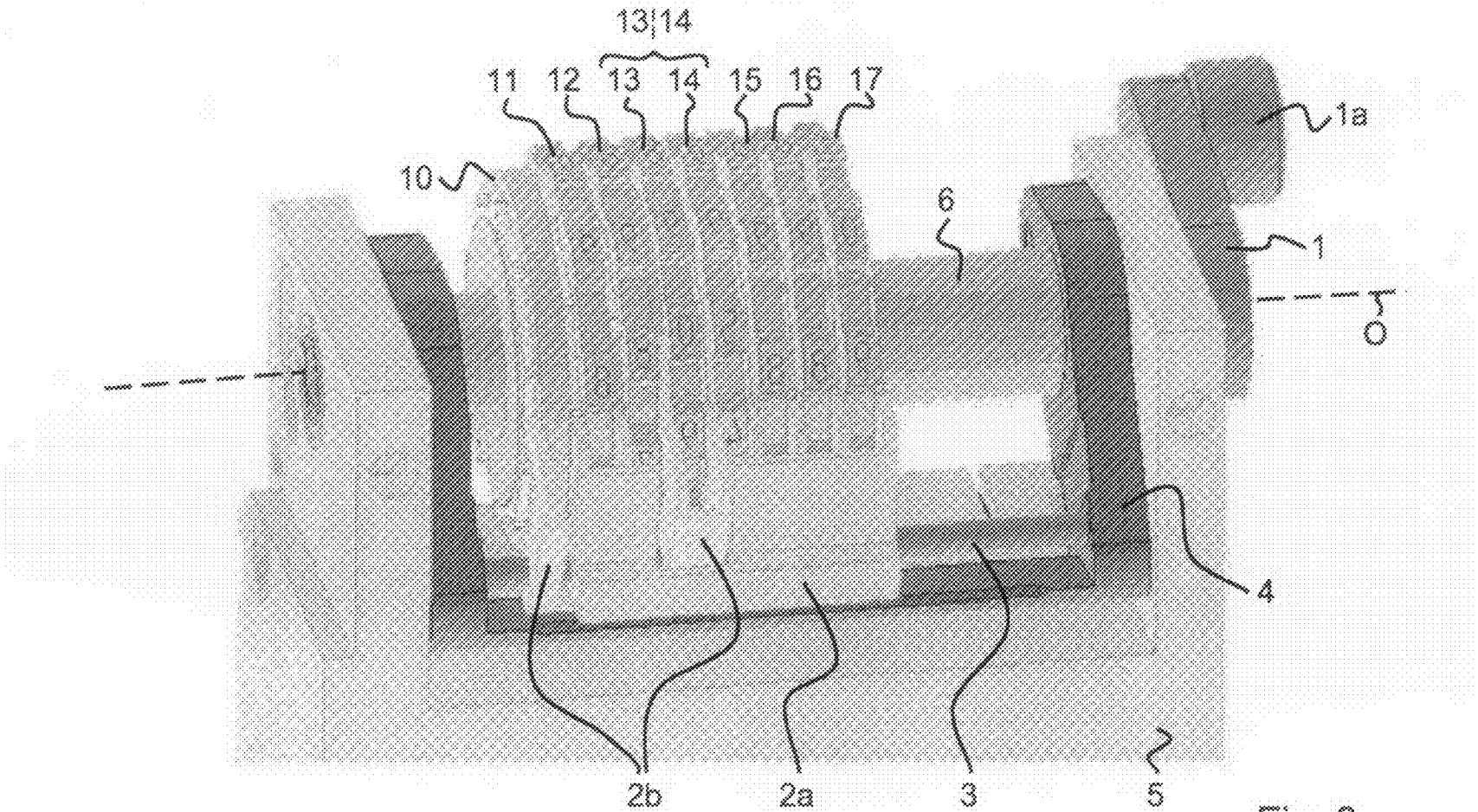
FIG. 8 is a perspective view of a numbering box to carry out the numbering process at location A1 on sheets as illustrated in FIGS. 1A to 1C.

Embodiments of the invention will now be described. For the sake of simplicity, it will be assumed that the substrates to be numbered take the form of individual sheets. The term "sheet" will therefore be used systematically in the following to designate a "substrate". It will however be appreciated that the substrates to be numbered could also take the form of repetitive lengths of a continuous web. Accordingly, within the scope of the present invention, the term "substrate" shall encompass both the notion of individual sheets or the notion of repetitive lengths of a continuous web.

A basic requirement for the numbering process of the present invention to be applicable is that the total number k*n of security prints printed onto each sheet (integers k and n designating respectively the number of columns and rows of security prints on each sheet) must be an integer multiple of ten or of twenty-five. The grounds for this restriction will appear more clearly from reading the following description. A further assumption is that numbering is performed on successive runs of $10^N$ successive sheets. Numbering on banknotes is typically performed on successive runs of hundred successive sheets (N=2), each run of hundred numbered sheets being then subjected to the cutting, bundling, banding and packing process already mentioned hereinabove. Each numbering run can alternatively be defined as a "layer", since consecutive runs cover consecutive layers of security prints with the serial numbers in sequence. Accordingly, the terms "run" and "layer" will be used in the following to designate one and a same object, namely a set of $10^N$ sheets numbered in sequence.

As already mentioned hereinabove, the numbering process comprises the step of numbering successive runs of $10^N$ substrates each, by providing each of the security prints with a serial number Serial#, the serial number Serial# being calculated with the formula:

$$\text{Serial\#}=\text{Start\#}+\alpha*[(r-1)*k*n*10^N+((i-1)*n+(j-1))*10^N+\text{MOD}(s-1;10^N)],$$

where:

Start# designates a starting number from which numbering starts, $\alpha$ is equal to −1 or +1 depending on whether numbering is carried out downwards or, respectively upwards, r identifies the run of $10^N$ successive sheets, i and j respectively identify the column and the row on the sheet where the security print to be numbered is located, and s is a number which identifies the sheet onto which the security print to be numbered is located.

In the following, it will be assumed for the sake of simplicity that numbering is carried out downwards ($\alpha$ being thus equal to −1). It shall be understood that numbering can equally be carried out upwards. In case of downward numbering, the above formula will thus read as follows:

$$\text{Serial\#}=\text{Start\#}-(r-1)*k*n*10^N-((i-1)*n+(j-1))*10^N-\text{MOD}(s-1;10^N).$$

For the purpose of explanation, it will further be assumed that each sheet carries fifty security prints arranged in an array comprising k=5 columns and n=10 rows and that the starting serial number Start# from which downward numbering starts is "X,1,000,000". These values are of course given purely as a non limiting example. With serial numbers ranging from "X,1,000,000" to "X,0,000,001", it will readily be understood that a closed set of one million separate prints can be numbered with unique serial numbers. This number can of course be increased by increasing the starting serial number Start#, adding digits to the serial number, and/or by the provision of one or more prefixes, such as letters or symbols as symbolised by the "X" symbol in the present example.

The number of digits and prefixes composing the serial number will of course be adapted to the closed set of security documents to be numbered. Typically, the number d of digits (excluding any prefixes) will range from five to eight digits.

FIGS. 1A to 1H and 2A to 2C have already been discussed in the preamble and will not be discussed further again. It will be recalled that these Figures refer to the situation were each sheet bear fifty security prints arranged in five (k=5) columns and ten (n=10) rows. The same numbering and processing principles as described in connection with FIGS. 1A to 1H, 2A to 2C and 3 are applicable to other sheet configurations as long as the total number of security prints to be numbered on each sheet is an integer multiple of ten or of twenty five. FIGS. 4A, 4B for instance illustrate an example where sheets carrying forty security prints arranged in five columns and eight rows are numbered according to the above principle while FIGS. 6A, 6B illustrate an example of numbering of sheets carrying twenty-five security prints arranged in five columns and five rows. The sheet layouts illustrated in FIGS. 1A to 1H, 4A, 4B, 6A and 6B are again purely illustrative. Sheets with forty security prints each may for instance be printed in such a way that the security prints are arranged in four columns and ten rows.

FIG. 3 is a table summarizing, for each position A1 to E10 on a sheet with fifty security prints as discussed with reference to FIGS. 1A to 1H and 2A to 2C, the evolution of digits 5, 4 and 3 of the serial numbers as they appear on consecutively-numbered sheets.

As summarized in FIG. 3, a particularity of the proposed numbering principle resides in the cyclic occurrence, at each numbering location, of determined digit pairs formed by digits 4 and 3 (hereafter designated as digit pairs 4|3). For instance, at numbering location A1, the following sequence of four distinct pairs of digits appears in cyclical manner:

"0|0-9|9-5|0-4|9"

More precisely, digit pair "0|0" appears at numbering location A1 when numbering the first sheet of layers 1, 3, 5, 7 etc. (i.e. the layers with an odd number) while digit pair "5|0" appears at numbering location A1 when numbering the first sheet of layers 2, 4, 6, 8, etc. (i.e. the layers with an even number). Digit pair "9|9", on the other hand, appears at numbering location A1 when numbering the remaining ninety-nine sheets of the layers with an odd number, while digit pair "4|9" appears at numbering location A1 when numbering the remaining ninety-nine sheets of the layers with an even number. The same situation occurs at each numbering location, the sequence of four pairs being however different in each case as summarized in the table of FIG. 3.

In the above example, which is based on the assumption that the sheets which are numbered carry fifty security prints each, the repetition cycle of the above sequences is two layers. The reason is as follows. The serial number of a given location within one layer will differ from the serial number at the same location within a subsequent layer by an amount equal to $k*n*10^N$ which corresponds to the total number of serial numbers in sequence within a given layer in the present case where N=2 and k*n=50, this implies that digit 4 (the N+2 digit), which corresponds to the thousands of the serial number will skip from one position to a lower position by $k*n*10^N/10^{N+1}=k*n/10=5$ increments. Since the digit 4 can take up to ten distinct values (i.e. numerals "0" to "9"), two layer cycles will be necessary to fall back again on the same position. Expressed in mathematical terms, the number of layers (or layer cycle) after which the sequence of digit pairs is repeated is given by the following formula:

$$LCM(k*n;100)/k*n,$$

where function LCM(x; y) returns the lowest common multiple of x and y.

In the case of numbering of sheets carrying forty security prints each, the layer cycle will accordingly be equal to five layers (LCM(40; 100)/40=200/40=5). Similarly, in the case of numbering of sheets carrying sixty security prints each, the layer cycle will also be equal to five layers (LCM(60; 100)/60=300/60=5). In the case of numbering of sheets carrying twenty-five security prints, the layer cycle will be equal to four layer (LCM(25; 100)/25=100/25=4). FIGS. 5 and 7 are tables similar to that of FIG. 3 summarizing the evolution of digits 5, 4 and 3 as they appear on consecutively-numbered sheets for each numbering position on sheets as illustrated in FIGS. 4A, 4B and 6A, 6B, respectively. As shown in FIG. 5, the sequence of digit pairs 4|3 starts again after five layers, while, in FIG. 7, the sequence of digits pairs 4|3 starts again after four layers.

As explained hereinabove, for each numbering location, there exists a determined sequence of digit pairs 4|3 that is repeated with a certain layer cycle. Consequently, the numbering wheels for digits 4 and 3 can be simplified to carry only the required digit pairs and be actuated simultaneously. As this will be described hereinafter, the numbering wheels for the digit pair 4|3 is constructed as one double wheel carrying the appropriate digit pairs.

Referring again to the table of FIG. 3, the sequence of digit pairs 4|3 for numbering location A1 is "0|0-9|9-5|0-4|9". As this sequence only comprise four distinct pairs, the sequence is preferably repeated twice or three times at regular intervals on the periphery of the double wheel, so that the double wheel exhibits eight or twelve numbering segments carrying two-digit numerals, which is the closest to the usual ten-segment configuration of the other numbering wheels. This is preferable to ensure that the angular displacement of each numbering wheel remains substantially the same among all numbering wheels. Depending on the number k*n of prints per sheet, the resulting double numbering wheel will be designed as an eight-segment, ten-segment or twelve-segment numbering wheel.

In the case of numbering sheets carrying forty security prints, the sequence of digit pairs 4|3 will include ten distinct pairs as illustrated in the table of FIG. 5. In this case, the sequence of digit pairs 4|3 will only appear once on the double wheel which takes the shape of a ten-segment double numbering wheel. The same applies when numbering sheets carrying sixty security prints as the repeat cycle of the sequence of digit pairs 4|3 is also five layer. In the case of numbering sheets carrying twenty-five security prints the sequence of digit pairs 4|3 will include eight distinct pairs as illustrated in the table of FIG. 7. In this case, the sequence of digit pairs 4|3 will only appear once on the double wheel which takes the shape of an eight-segment double numbering wheel.

Triggering of the numbering wheel which directly follows the double numbering wheel, namely the numbering wheel for digit 5 (=N+3) is initiated when the double wheel for digit pair 4|3 passes by a "virtual zero", i.e. rotates from a numbering position where the two-digit number is lower than the two-digit number of the subsequent numbering position. For instance, in the case of sheets carrying fifty prints each, actuation of the numbering wheel for digit 5 occurs, at numbering location A1, when the double wheel rotates from the numbering segment bearing digit pair "0|0" to the subsequent numbering segment bearing digit pair "9|9". For numbering location B5, this happens when the double wheel rotates from the numbering segment bearing digit pair "3|5" to the subsequent numbering segment bearing digit pair "8|6". These "triggering points" are schematically indicated in the table of FIGS. 3, 5 and 7 by thick black lines.

In the present example, as the serial numbers applied to the security prints of the first sheet of each layer all have 0's as the two least significant digits, the digit pair 4|3 switches to a lower position between the first and second sheets of each layer as illustrated in the tables of FIGS. 3, 5 and 7. This implies that the digit pair 4|3 changes twice in succession, i.e. when switching from one layer to the next and when switching from the first sheet to the second sheet of each layer. Referring for instance to numbering location B5 in FIGS. 1C, 1D and 1E (the same applying for all other numbering locations), the serial numbers which are successively printed on the last sheet of layer 1, i.e. the $100^{th}$ sheet, and the first and second sheets of layer 2, i.e. the $101^{st}$ and $102^{nd}$ sheets, are respectively "X,0,998,501", "X,0,993,600" and "X,0,993,599", the digit pair 4|3 successively changing from "8|5" to "3|6" to "3|5". As actuation of the double wheel for digit pair 4|3 is to be triggered on the basis of the numbering wheel for digit 2, and as digit 2 of the serial number remains equal to "0" when switching from the last sheet of a layer to the first sheet of the subsequent layer, this implies that the numbering wheel for digit 2 must carry an eleventh numbering segment bearing a second "0" numeral following the first "0" numeral. In this particular numbering example, numbering wheel for digit 2 is thus designed as a wheel with eleven numbering segments bearing two successive zeroes. In addition, as rotation of the numbering wheel for digit 2 is triggered by the units numbering wheel, which situation occurs ten times during a run of hundred sheets, the actuation mechanism must be designed so as to trigger an additional rotation of the eleven-segment numbering wheel for digit 2.

FIG. 8 is a schematic perspective view of a numbering box to carry out the proposed numbering process. The numbering box illustrated in FIG. 8 is specifically designed for numbering location A1 on sheets with fifty security prints each. This numbering box comprises seven numbering wheels designated respectively by references 11 to 17. Additional numbering wheels and/or prefix wheels might be provided but these have not been illustrated in FIG. 8 for the sake of simplicity. Numbering wheels 11 to 17 correspond respectively to the numbering wheels for digits 1 to 7 of the serial number. As mentioned hereinabove, numbering wheels 13 and 14 for digits 3 and 4 are designed as a double numbering wheel carrying a determined sequence of digit pairs.

The numbering wheels 11 to 17 are mounted on a common shaft 6 supported in a frame 5, each numbering wheel being capable to rotate around a common axis O defined by the shaft 6. An additional cam wheel 10 is provided next to the first numbering wheel 11. The purpose of this cam wheel 10 will become apparent in the following.

The wheels 10 to 17 are linked together by an actuation mechanism which controls sequential rotation of the wheels. This actuation mechanism comprises an actuation lever 1 which is secured to the shaft 6 and rotates around the same axis O as the wheels 10 to 17. The actuation lever 1 carries at one end an actuation roll 1*a* that is designed to roll on a corresponding actuation curve or cam (not shown) which is typically located on the numbering cylinder carrying the numbering boxes as is known in the art, the lever 1 experiencing a back and forth movement during actuation. The purpose of the actuation lever 1 is to initiate the sequential actuation of wheels 10 to 17. To this end, the actuation lever 1 is linked to a catch carrier 4 which is supported rotatably about the rotation axis O, this catch carrier following the same back and forth rotational movement as the lever 1 during actuation. The catch carrier 4 supports two actuation pawls, or catches, 2*a*, 2*b* comprising respectively six and three parallel finger members extending on the sides of the wheels 10 to 17. Both pawls 2*a*, 2*b* are mounted on an axis 3 secured at both ends to the catch carrier 4. The pawls 2*a*, 2*b* are pre-stressed by a springs (not illustrated) in such a way that the parallel finger members of the pawls are pressed in the direction of ratchet or cam profiles present at the sides of the wheels 10 to 17, the first actuation pawl 2*a* cooperating with wheels 11, 12, 14, 15, 16 and 17 while the second actuation pawl 2*b* cooperates with wheels 10, 12 and 13.

Figure 9:
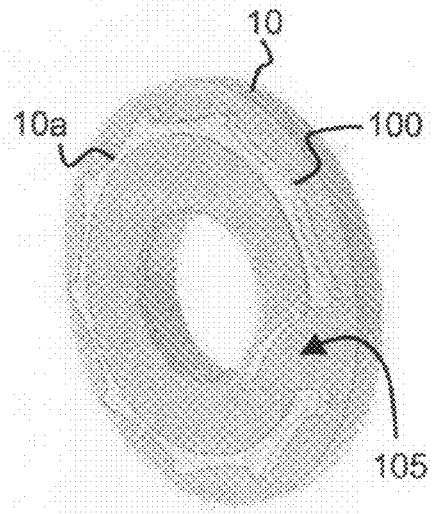
FIG. 9 is a perspective view of a cam wheel of the numbering box of FIG. 8.

Cam wheel 10 is illustrated in greater detail in FIG. 9 and is designed as a disc provided with a ratchet profile 10*a* on its left-hand side. The ratchet profile 10*a* exhibits ten indentations 100 and one notch 105. This ratchet profile 10*a* cooperates with the first finger member of the second actuation pawl 2*b*.

Figure 10:
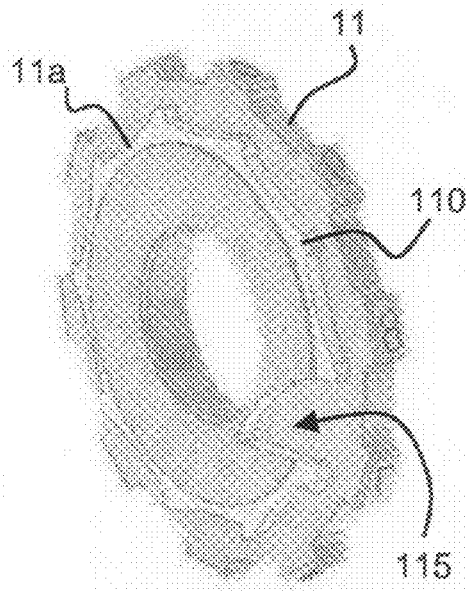
FIG. 10 is a perspective view of the units numbering wheel of the numbering box of FIG. 8.

Numbering wheel 11 is illustrated in greater detail in FIG. 10. It is designed as a conventional ten-segment numbering wheel bearing the sequence of ten numerals "0" to "9". Similarly to the cam wheel 10, numbering wheel 11 is further provided on its left-hand side with a ratchet profile 11*a* exhibiting ten indentations 110 and one notch 115, the position of the notch 115 being such that the first finger member of the first actuation pawl 2*a* falls in the notch 115 when numbering wheel 11 is positioned to print numeral "0", thereby allowing the next finger member of the first actuation pawl 2*a* to get into contact with the ratchet profile of the subsequent numbering wheel to be actuated, namely numbering wheel 12.

Figure 11A:
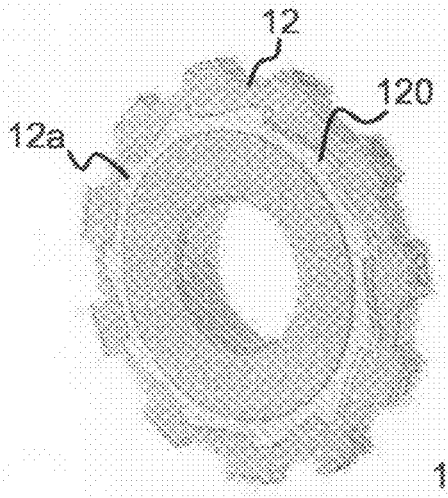
FIGS. 11A and 11B are perspective views of both sides of the tenths numbering wheel of the numbering box of FIG. 8.
Figure 11B:
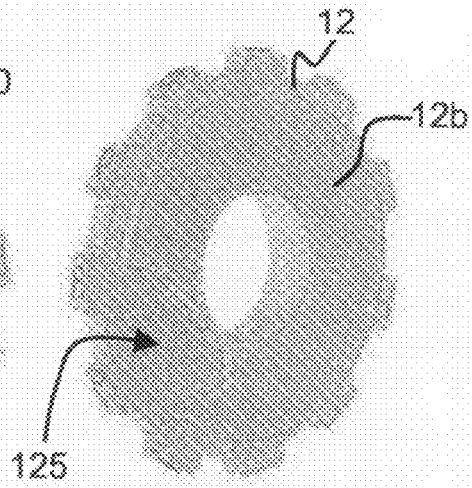

Numbering wheel 12 is illustrated in greater detail in FIGS. 11A and 11B. In the present example, in contrast to conventional numbering wheels, wheel 12 is designed as an eleven-segment numbering wheel bearing the sequence of numerals "0" to "9" with two successive 0's, i.e. a sequence of eleven numerals as follows: "0-0-1-2-3-4-5-6-7-8-9". Numbering wheel 12 is further provided on its left-hand side with a ratchet profile 12*a* exhibiting eleven indentations 120 but no notch, this ratchet profile 12*a* cooperating with the second finger member of the first actuation pawl 2*a*.

On the right-hand side of numbering wheel 12, there is further provided a cam profile 12*b* exhibiting one notch 125. This cam profile 12*b* cooperates with the second finger member of the second actuation pawl 2*b* and is used to selectively activate or deactivate the second pawl 2*b*. The size of notch 125 is such that the second finger member of the second actuation pawl 2*b* falls in the notch 125 (and is thereby activated) only for two consecutive segments of numbering wheel 12, namely when wheel 12 is positioned to print either one of the two consecutive "0" numerals. For the remaining positions of wheel 12, actuation pawl 2*b* presses against the circular periphery of the cam profile 12*b* and is deactivated. While being "deactivated", pawl 2*b* prevents the first actuation pawl 2*a* from actuating wheel 14, and as a consequence, any of the other subsequent wheels 15 to 17. Indeed, it this configuration, actuation pawl 2*b* stops the first actuation pawl 2*a* from moving further towards the ratchet profile of wheel 14. As this will be appreciated from the following, actuation pawl 2*a* will only be able to actuate wheel 14 and any of the subsequent wheels, when both the notch 115 of the ratchet profile 11*a* of numbering wheel 11 and the notch 125 of the cam profile 12*b* of wheel 12 face the second actuation pawl 2*b* (i.e. when both digit 1 and digit 2 of the serial number are equal to "0"), which situation occurs only once during each run of hundred consecutive sheets.

Figure 12A:
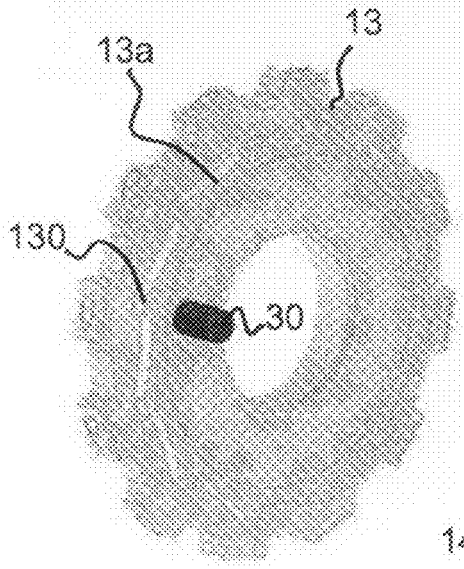
FIGS. 12A and 12B are perspective views of the hundredths and thousandths numbering wheels of the numbering box of FIG. 8.
Figure 12B:
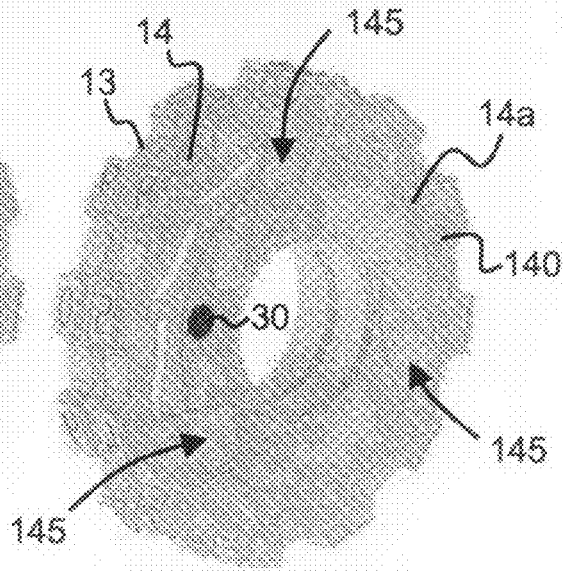

Numbering wheels 13 and 14 are illustrated in greater detail in FIGS. 12A and 12B. Numbering wheels 13 and 14 are secured together by means of a pin 30 so as to form a double numbering wheel 13|14. Both wheels 13 and 14 are designed as twelve-segment numbering wheels respectively bearing the sequences of numerals "0-9-0-9-0-9-0-9-0-9-0-9" and "0-9-5-4-0-9-5-4-0-9-5-4", the wheels being combined together so that the resulting double numbering wheel 13|14 bears the sequence of twelve digit pairs "0|0-9|9-5|0-4|9-0|0-9|9-5|0-4|9-0|0-9|9-5|0-4|9", i.e. three times the sequence of digit pairs "0|0-9|9-5|0-4|9" which is the corresponding sequence of digit pairs 4|3 for numbering location A1 on sheets carrying fifty security prints as already mentioned hereinabove.

On the right-hand side of numbering wheel 13, as shown in FIG. 12A, there is provided a ratchet profile 13*a* with twelve indentations 130 which cooperates with the third and last finger member of the second actuation pawl 2*b*. This ratchet profile 13*a* could alternatively be provided on the left-hand side of numbering wheel 14, the resulting configuration being the same, i.e. a ratchet profile disposed between numbering wheels 13 and 14.

On the right-hand side of numbering wheel 14, as shown in FIG. 12B, there is provided a ratchet profile 14*a* with twelve indentations 140 and three notches 145 distributed at 120 degrees one with respect to the others. This ratchet profile 14*a* cooperates with the third finger member of the first actuation pawl 2*a*. The notches 145 on the ratchet profile 14*a* are positioned such that the corresponding finger member of the first actuation pawl 2*a* falls within the notches 145 at times when actuation of the subsequent numbering wheel (i.e. numbering wheel 15) has to be performed, namely when the digit pair 4|3 switches from "0|0" to "9|9" (i.e. passes by the above-mentioned "virtual zero"), which situation occurs three times for each complete revolution of the double numbering wheel in this present example.

Figure 13:
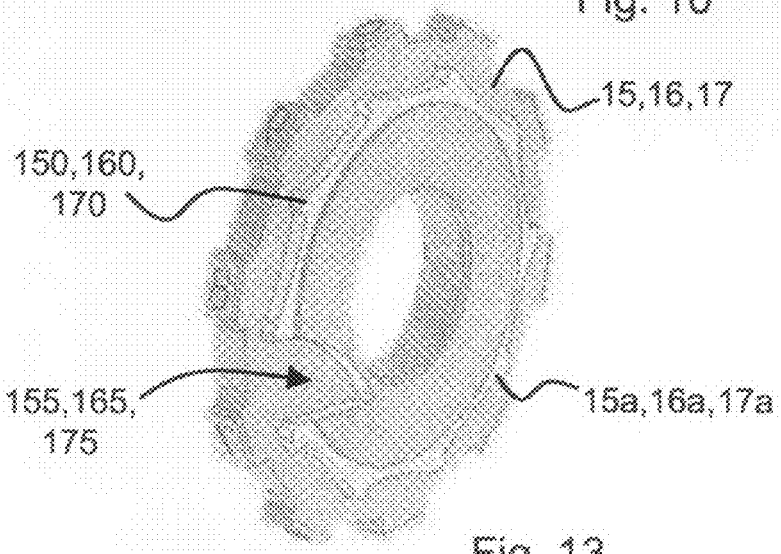
FIG. 13 is a perspective view of the ten-thousandths, hundred-thousandths and millionths numbering wheels of the numbering box of FIG. 8.

Numbering wheels 15 to 17 are illustrated in greater detail in FIG. 13. They are the mirror image of numbering wheel 11, i.e. they are also constructed as ten-segment numbering wheels bearing the sequence of numerals "0" to "9", ratchet profiles 15*a*, 16*a*, 17*a* with ten indentations 150, 160, 170 and one notch 155, 165, 175 being provided on the right-hand side of the wheels (rather than on the left-hand side). The ratchet profiles 15*a*, 16*a*, 17*a* on the numbering wheels 15, 16, 17 cooperate with the remaining three finger members of the first actuation pawl 2*a*.

Figure 14A:
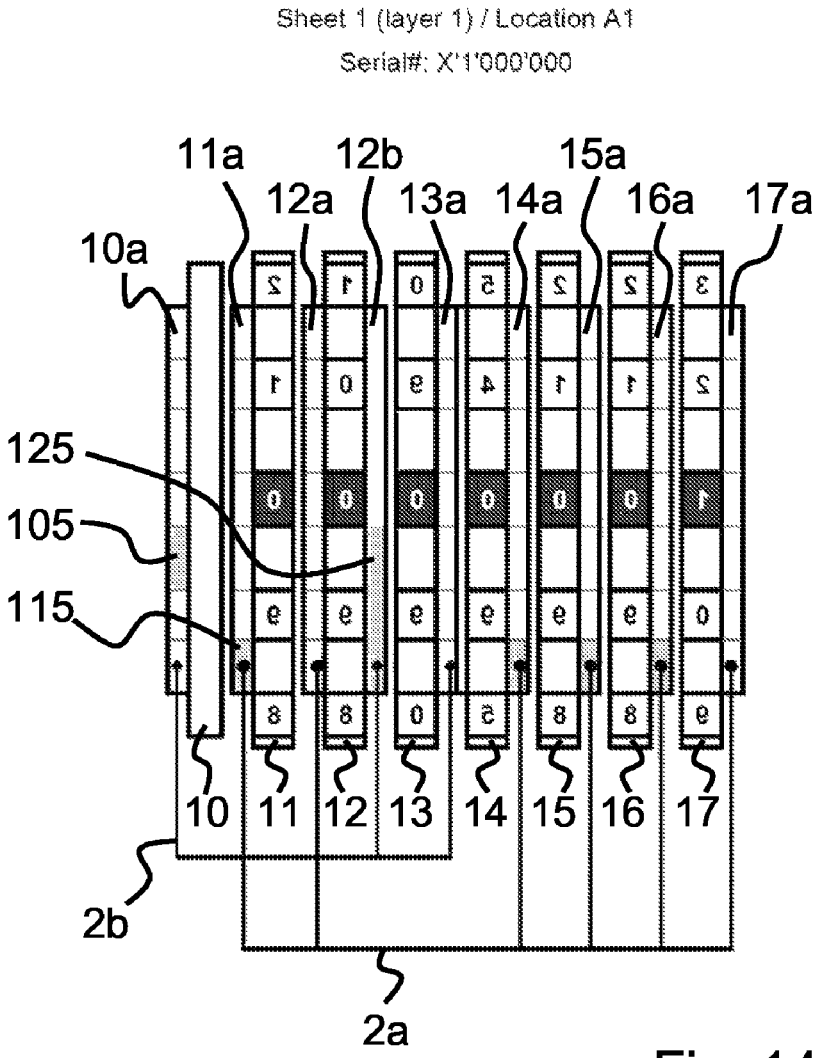
FIGS. 14A to 14C illustrate the actuation principle of the numbering box of FIG. 8.
Figure 14B:
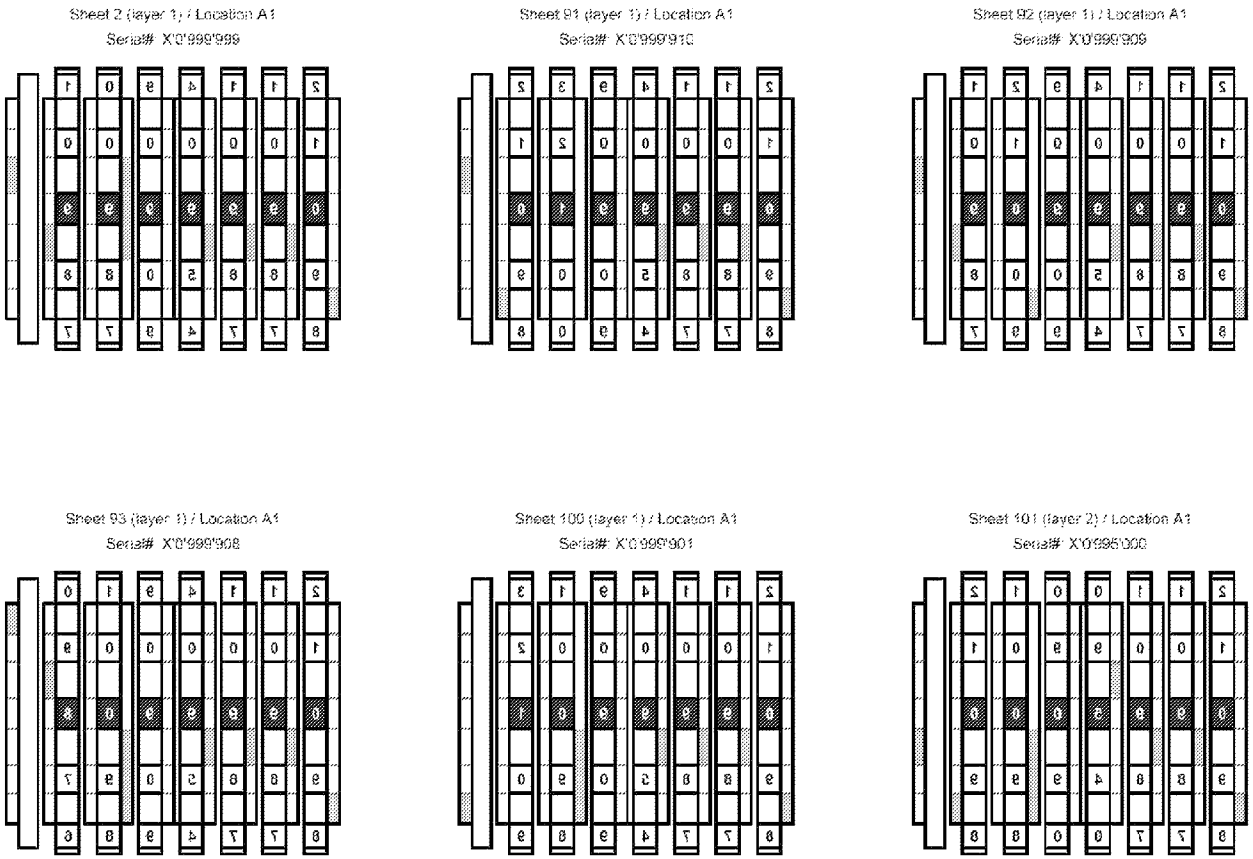
Figure 14C:
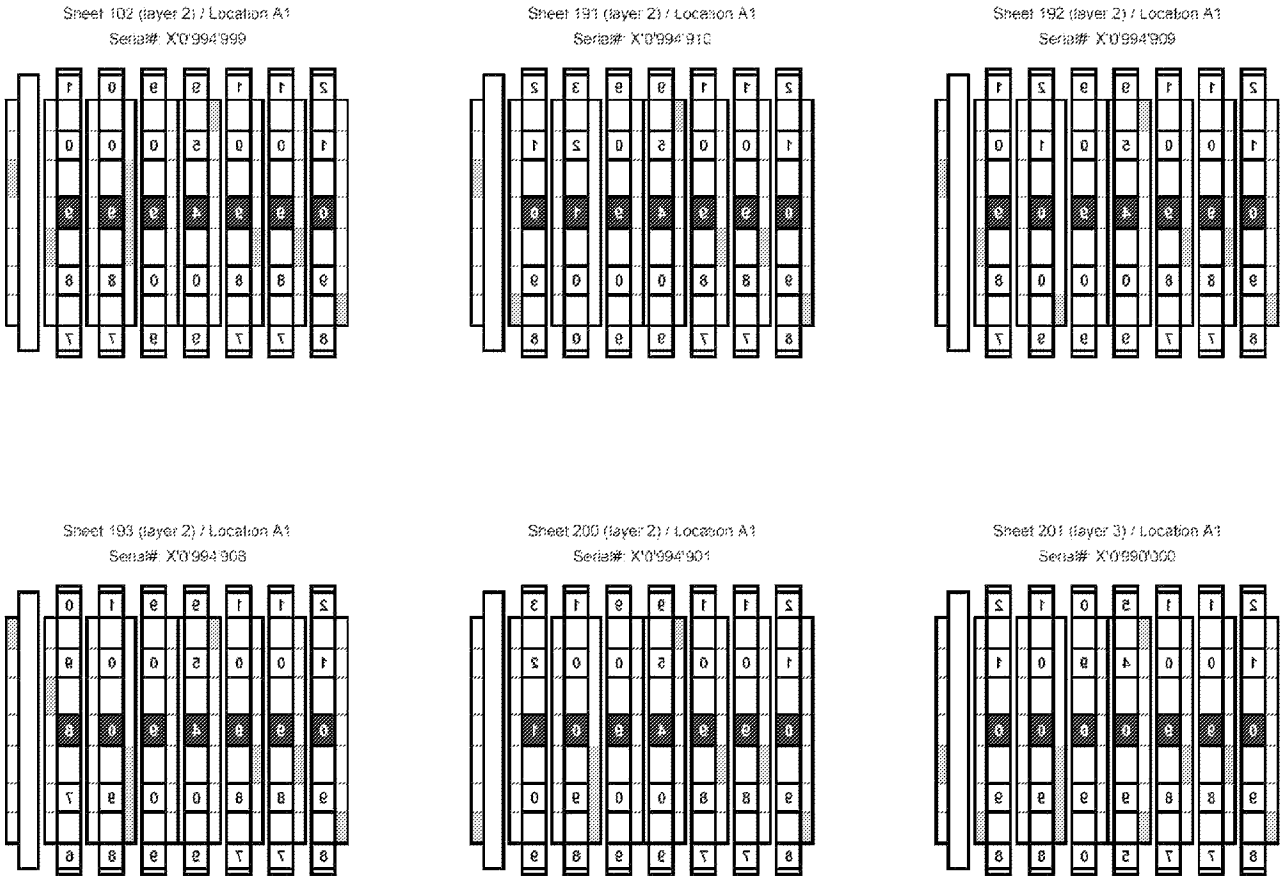

The depths of the gaps between the indentations of the ratchet profiles, the depths of the notches, and the length of the associated finger members of the actuation pawls 2*a*, 2*b* are designed and dimensioned to actuate the wheels according to the actuation sequence which will now be described. The actuation principle of the box of FIG. 8 is schematically illustrated in the drawings of FIGS. 14A to 14C where the positions of wheels 10 to 17 are schematically illustrated for different numbering situations. More precisely, the drawings illustrate the positions of wheels 10 to 17 while numbering the $1^{st}$ sheet (FIG. 14A), the $2^{nd}$, $91^{st}$, $92^{nd}$, $93^{rd}$, $100^{th}$ and $101^{st}$ sheets (FIG. 14B), and the $102^{nd}$, $191^{st}$, $192^{nd}$, $193^{rd}$, $200^{th}$ and $201^{st}$ sheets (FIG. 14C). As indicated in FIG. 14A, the drawings show, from left to right, the cam wheel 10, the units numbering wheel 11, the tenths numbering wheel 12, the double numbering wheel 13|14 for the hundredths and thousandths, the ten-thousandths numbering wheel 15, the hundred-thousandths numbering wheel 16 and the millionths numbering wheel 17. The numerals composing the serial number are shown as white characters on a dark background. Also illustrated are the respective ratchet profiles 10*a* to 17*a* of wheels 10 to 17 as well as the cam profile 12*b* of wheel 12. Furthermore, the grey areas on the profiles indicate schematically the presence of the above-mentioned notches 105, 115, 125, 145, 155, 165 and 175 in the profiles 10*a*, 11*a*, 12*b*, 14*a*, 15*a*, 16*a* and 17*a* of wheels 10, 11, 12, 14, 15, 16 and 17.

In FIGS. 14A to 14C the wheels are shown with equal spacing between the numbering segments for the sake of simplicity. In this particular embodiment, it shall however again be understood, as illustrated in FIGS. 8 to 13, that wheels 11 and 15 to 17 are ten-segment numbering wheels, while wheels 12 and 13|14 are respectively eleven- and twelve-segment wheels.

In addition, FIG. 14A schematically shows the two actuation pawls 2*a* and 2*b* of the actuating mechanism with their finger members cooperating with the corresponding ratchet/cam profiles and notches. For the sake of simplicity, the pawls 2*a*, 2*b* are not illustrated in FIGS. 14B and 14C. In the representation of FIG. 14A it shall for instance be understood that the ends of the first, third, fourth and fifth finger members of the first actuation pawl 2*a* respectively cooperate with the notches 115, 145, 155 and 165 of the ratchet profiles 11*a*, 14*a*, 15*a* and 16*a* of wheels 11, 14, 15 and 16, while the ends of the second and sixth finger members of the first actuation pawl 2*a* respectively contact the ratchet profiles 12*a* and 17*a* of wheels 12 and 17. Similarly, it shall be understood, in this representation, that the ends of the first and third finger members of the second actuation pawl 2*b* respectively contact the ratchet profiles 10*a* and 13*a* of wheels 10 and 13, while the end of the second finger member of the second actuation pawl 2*b* cooperates with the notch 125 of the cam profile 12*b* of wheel 12. In the configuration illustrated in FIG. 14A, the second actuation pawl 2*b* is thus considered to be active, the first actuation pawl 2*a* being accordingly free to actuate wheels 14 to 17.

Actuation of the wheels 10 to 17 occurs as follows:

starting from the $1^{st}$ sheet (FIG. 14A) which bears serial number X,1,000,000, wheels 11 to 16 are in the "0" numbering position (wheel 12 being positioned in its second "0" numbering position) while wheel 17 is in the "1" numbering position; at this stage, the second actuation pawl 2*b* is activated (through cooperation of its second finger member with the notch 125 on the cam profile 12*b* of wheel 12), thereby allowing the first actuation pawl 2*a* to actuate wheels 14, 15, 16 and 17; the first actuation pawl 2*a* cooperates in this configuration with the ratchet profiles 11*a*, 12*a*, 14*a*, 15*a* and 16*a* of wheels 11, 13|14, 15 and 16;

when switching from the $1^{st}$ sheet to the $2^{nd}$ sheet (FIG. 14B), the first actuation pawl 2*a* actuates each of the wheels 11, 12, 13|14, 15, 16 and 17 to the lower numbering positions, i.e. from "0", "0", "0|0", "0", "0", "1" to "9", "9", "9|9", "9", "9", "0" respectively, the resulting serial number thereby changing from "X,1,000,000" to "X,0,999,999"; in the process, the second actuation pawl 2*b* also causes cam wheel 10 to rotate to a subsequent position, this being schematically illustrated by the displacement of the grey area symbolising notch 105;

from the $2^{nd}$ sheet to the $91^{st}$ sheet (FIG. 14B), the second actuation pawl 2*b* is deactivated as the second finger member of the pawl does not anymore face notch 125 of the cam profile 12*b*, and the first actuation pawl 2*a* sequentially actuates wheels 11 and 12, wheel 12 rotating to the lower numbering position each time wheel 11 changes over from numbering positions "9" to "0"; the resulting serial number thereby changes successively from "X,0,999,999" for the 2$^{nd}$ sheet to "X,0,999,910" for the 91$^{st}$ sheet; during this process, wheels 10, 13|14 and 15 to 17 are not actuated and do not move;

when switching from the 91$^{st}$ sheet to the 92$^{nd}$ sheet (FIG. 14B), the first actuation pawl 2*a* actuates wheels 11 and 12 to the lower numbering positions, wheel 12 rotating to its first "0" numbering position, thereby activating the second pawl 2*b* for the next iteration; the serial number changes in the process from "X,0,999,9100" to "X,0,999,909";

when switching from the 92$^{nd}$ sheet to the 93$^{rd}$ sheet (FIG. 14B), the first actuation pawl 2*a* actuates wheel 11 to the lower numbering position, while the second actuation pawl 2*b* causes an extra actuation of wheel 12 (through cooperation of the second finger member of the pawl with the wall of notch 125) which rotates to its second "0" numbering position; in the process, actuation pawl 2*b* also actuates cam wheel 10 to its subsequent position; the serial number changes from X,0,999,909" to "X,0,999,908";

from the 93$^{rd}$ sheet to the 100$^{th}$ sheet (FIG. 14B), the first actuation pawl 2*a* actuates wheel 11 sequentially seven times through the lower numbering positions, i.e. from numbering position "8" to "1", while actuation pawl 2*b* sequentially actuates cam wheel 10 seven times through subsequent positions; at the end of this process, the first finger member of actuation pawl 2*b* faces and falls into the notch 105 of the ratchet profile 10*a* of the cam wheel 10; in the process, the serial number sequentially changes from "X,0,999,908" to "X,0,999,901";

when switching from the 100$^{th}$ sheet to the 101$^{st}$ sheet (FIG. 14B), the first actuation pawl 2*a* actuates wheel 11 to the "0" numbering position, while the second actuation pawl 2*b* causes actuation of cam wheel 10 and of double numbering wheel 13|14 (due to the cooperation of the pawl 2*b* with notch 105 of cam wheel 10), thus changing the numbering position of double wheel 13|14 from the "9|9" to the "5|0" position; the resulting serial number thus changes from X,0,999,901" to "X,0,995,000".

Actuation of wheels 10 to 17 occurs basically in a similar way from the 101$^{st}$ sheet to 201$^{st}$ sheet, namely when switching from the 101$^{st}$ sheet to the 102$^{nd}$ sheet (FIG. 14C), the first actuation pawl 2*a* actuates each of the wheels 11, 12 and 13|14 to the lower numbering positions, i.e. from "0", "0", "5|0" to "9", "9", "4|9", respectively, the resulting serial number thereby changing from "X,0,995,000" to "X,0,994,999"; in the process, the second actuation pawl 2*b* also causes cam wheel 10 to rotate to a subsequent position; wheels 15, 16 and 17 are not actuated as the first pawl 2*a* does not face any of the notches 145 on the ratchet profile 14*a* of wheel 14 and is kept away from the ratchet profiles of the subsequent wheels;

from the 102$^{nd}$ sheet to the 191$^{st}$ sheet (FIG. 14C), the second actuation pawl 2*b* is again deactivated, and the first actuation pawl 2*a* sequentially actuates wheels 11 and 12, the resulting serial number thereby changing successively from "X,0,994,999" for the 102$^{nd}$ sheet to "X,0,994,910" for the 191$^{st}$ sheet; during this process, wheels 10, 13|14 and 15 to 17 are again not actuated and do not move;

when switching from the 191$^{st}$ sheet to the 192$^{nd}$ sheet (FIG. 14C), the first actuation pawl 2*a* actuates wheels 11 and 12 to the lower numbering positions, wheel 12 rotating to its first "0" numbering position, thereby activating the second pawl 2*b*; the serial number changes in the process from "X,0,994,910" to "X,0,994,909";

when switching from the 192$^{nd}$ sheet to the 193$^{rd}$ sheet (FIG. 14C), the first actuation pawl 2*a* actuates wheel 11 to the lower numbering position, while the second actuation pawl 2*b* causes an extra actuation of wheel 12 which rotates to its second "0" numbering position; in the process, actuation pawl 2*b* also actuates cam wheel 10 to its subsequent position; the serial number changes from X,0,9949,909" to "X,0,994,908";

from the 193$^{rd}$ sheet to the 200$^{th}$ sheet (FIG. 14C), the first actuation pawl 2*a* actuates wheel 11 sequentially seven times through the lower numbering positions, i.e. from numbering position "8" to "1", while actuation pawl 2*b* sequentially actuates cam wheel 10 seven times through subsequent positions; in the process the serial number changes from "X,0,994,908" to "X,0,994,901";

when switching from the 200$^{th}$ sheet to the 201$^{st}$ sheet (FIG. 14C), the first actuation pawl 2*a* actuates wheel 11 to the "0" numbering position, while the second actuation pawl 2*b* causes actuation of cam wheel 10 and of double numbering wheel 13|14 (the second actuation pawl 2*b* again falling into the notch 105 of the cam wheel 10), thus changing the numbering position of double wheel 13|14 from the "4|9" back to the "0|0" position; the resulting serial number thus changes from X,0,994,901" to "X,0,990,000".

This actuation principle is repeated for each series of two-hundred sheets.

The above-described numbering box configuration and actuation principle is the same for all numbering locations, the only difference residing in the sequence of digit pairs carried by the double numbering wheel 13|14.

One simplification of the numbering box configuration shown in FIG. 8 may consist in restricting the starting serial number (Starts) to a particular series of numbers. More particularly, for downward numbering, if the starting serial number is a number with 9's as the two least significant digits of the serial number (for instance "X,0,999,999" rather than "X,1,000,000) then the digit pair 4|3 will remains the same for all hundred consecutive sheets of each run. For instance, for numbering location A1 on sheets with fifty security prints, the 1$^{st}$ to 100$^{th}$ sheets (i.e. layer 1) will be numbered with the serial numbers "X,0,999,999" to "X,0,999,900", digit pair 4|3 being equal to "9|9" during the whole run, while, for the same numbering location A1, the 101$^{st}$ to 200$^{th}$ sheets (i.e. layer 2) will be numbered with the serial numbers "X,0,994,999" to "X,0,994,900", digit pair 4|3 being equal to "4|9" during the whole run. In contrast to the previous numbering example where the closed set of one million documents were numbered with serial numbers ranging from "X,0,000,001" to "X,1,000,000", the closed set of one million documents will be numbered in this second example with serial numbers ranging from "X,0,000,000" to "X,0,999,999".

With this minor restriction regarding the starting serial number, there is no need anymore for a tenths numbering wheel with eleven segments as the digit pair 4|3 only changes once for hundred consecutive sheets, namely when switching from one layer to the next. In addition, the sequence of digit pairs 4|3 is reduced in length by half, for each numbering location, as compared to the previous example. For instance, for numbering location A1 on sheets with fifty prints each, the sequence of digit pairs 4|3 becomes simply "9|9-4|9". This implies that the double numbering wheel can also be designed as a ten-segment numbering wheel bearing, in this example, five times the sequence "9|9-4|9".

Figure 15A:
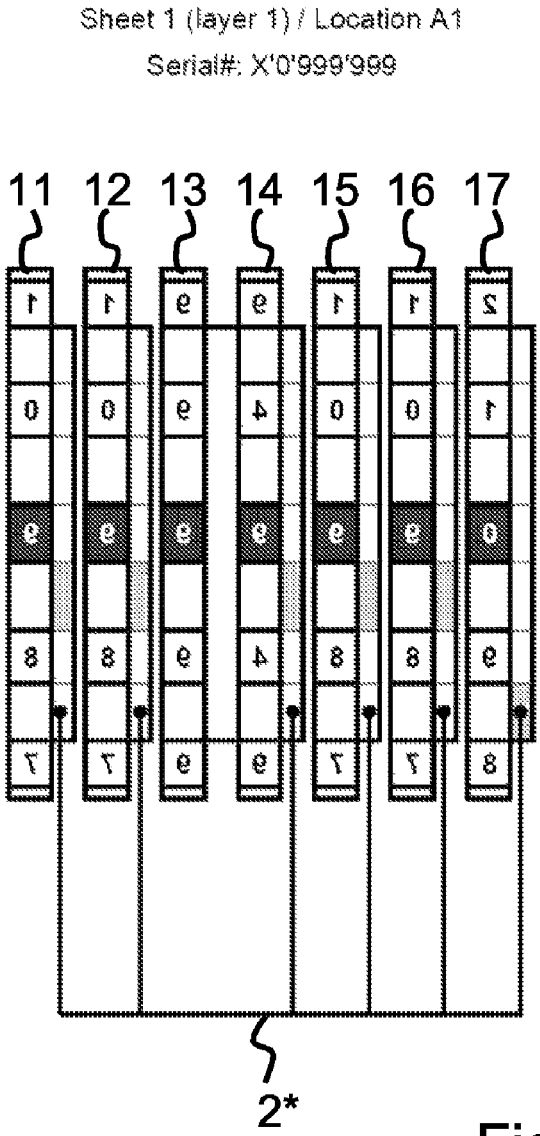
FIG. 15A is a schematic illustration of a simplified embodiment of a numbering box to carry out the numbering process of the invention.
Figure 15B:
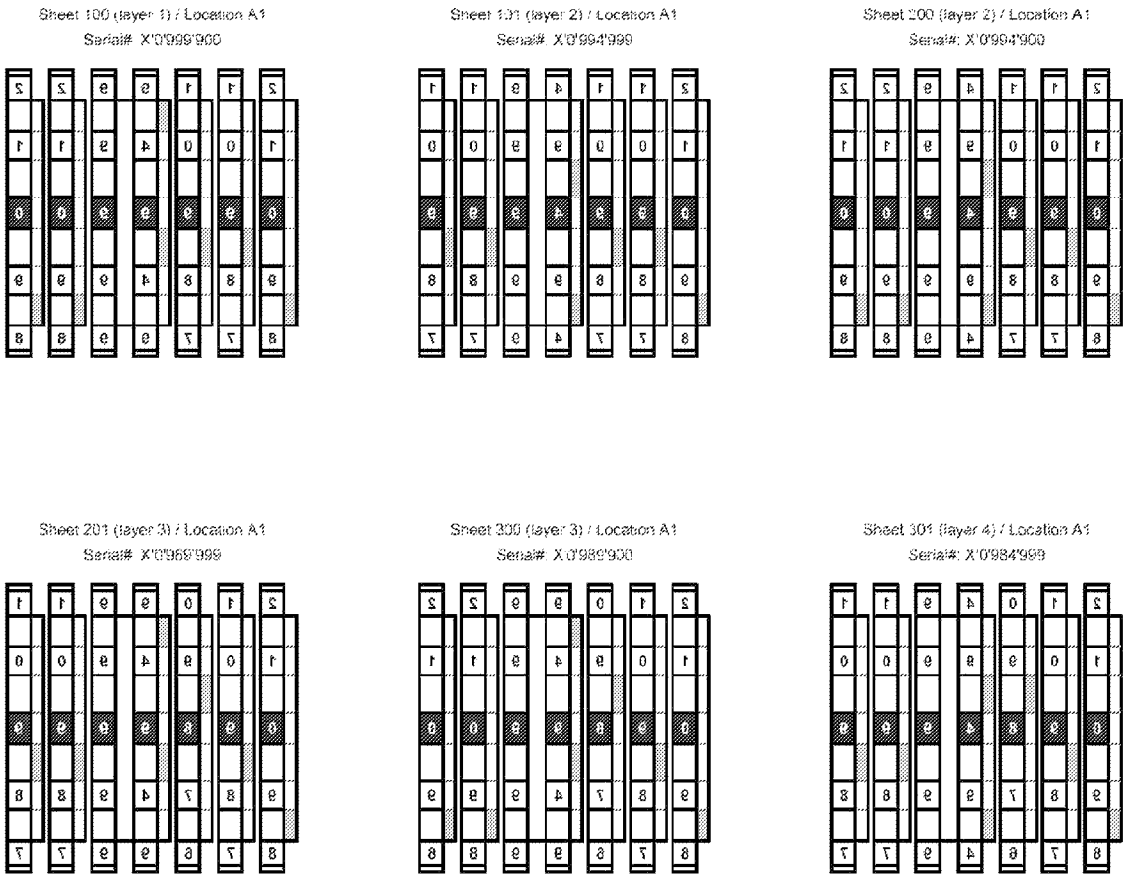
FIG. 15B illustrates the actuation principle of the numbering box of FIG. 15A.

The consequence of the above restriction is that the second actuation pawl 2*b* shown in FIG. 8 as well as the cam wheel 10 is not anymore required. FIG. 15A is a schematic illustration of a simplified numbering box for carrying out the downward numbering process mentioned hereinabove at location A1 on sheets with fifty prints. The actuation mechanism is as simple as for conventional mechanical numbering boxes, i.e. it only requires one actuation pawl 2* for actuating the numbering wheels 11 to 17. FIG. 15B illustrates the positions of the wheels of the numbering box of FIG. 15A while numbering the $100^{th}$, $101^{st}$, $200^{th}$, $201^{st}$, $300^{th}$ and $301^{st}$ sheets.

Figure 16A:
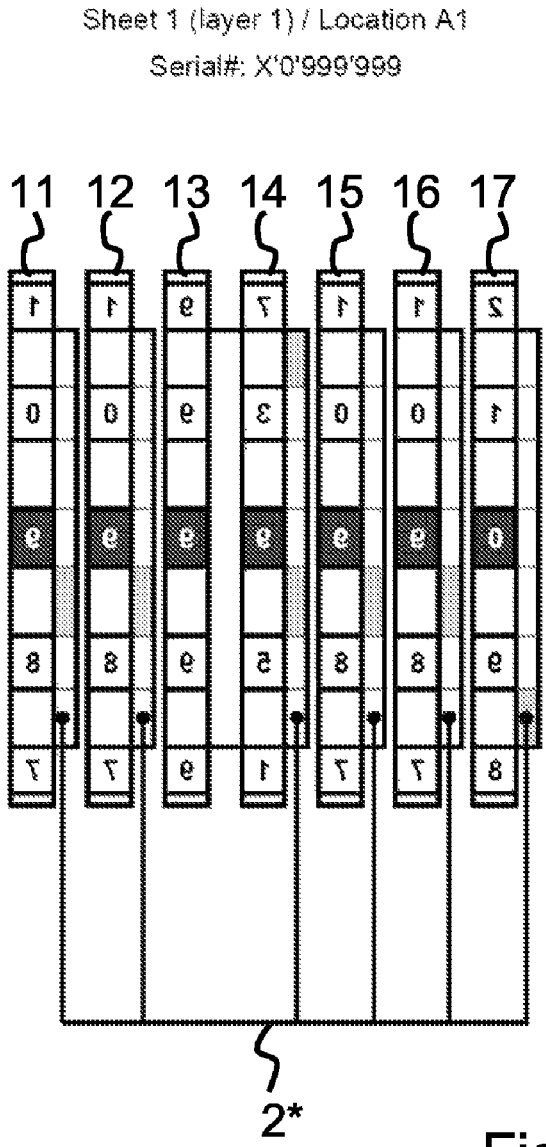
FIG. 16A is a schematic illustration of another simplified embodiment of a numbering box to carry out the numbering process of the invention.
Figure 16B:
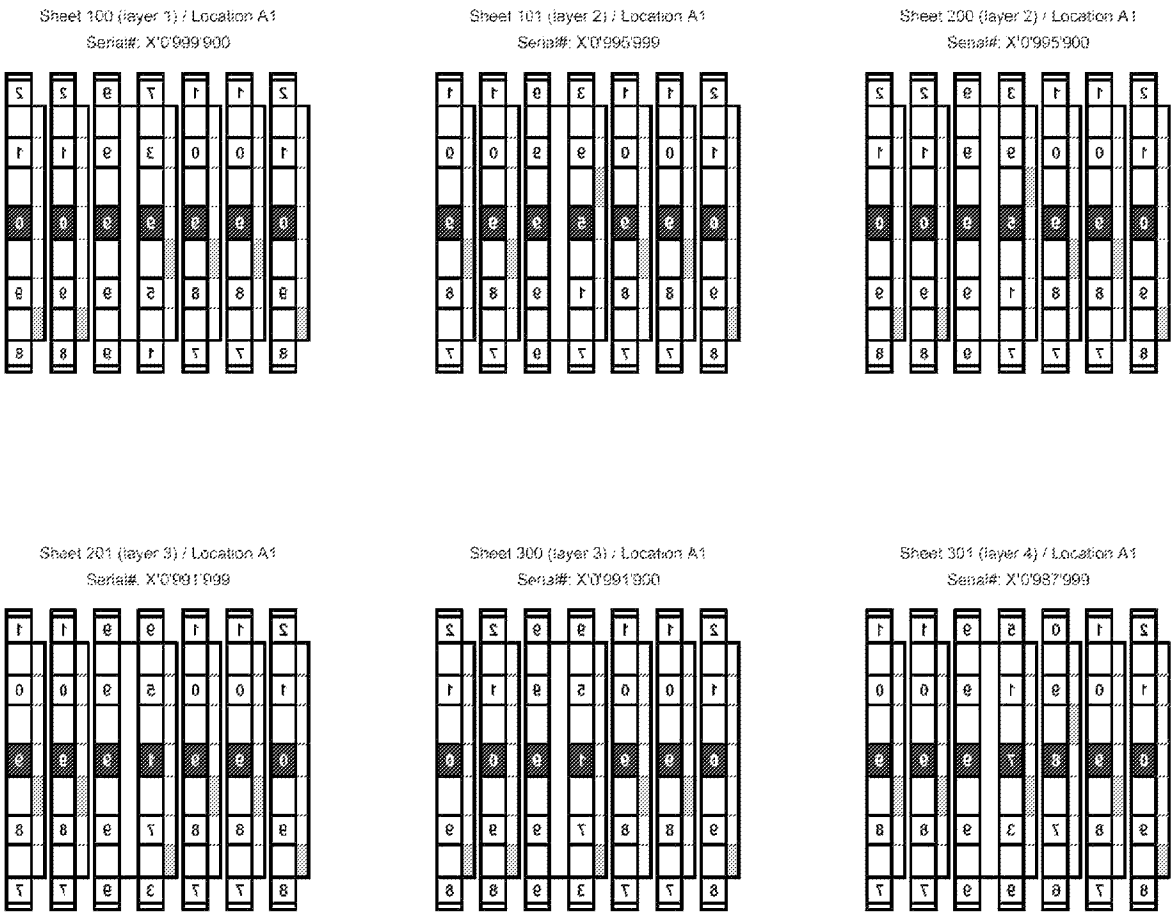
FIG. 16B illustrates the actuation principle of the numbering box of FIG. 16A.

FIG. 16A is a schematic illustration of still another embodiment of the simplified numbering box configuration for downward numbering at location A1 on sheets with forty security prints. In this example, the sequence of digit pairs 4|3 for numbering location A1 is "9|9-5|9-1|9-7|9-3|9", which sequence is repeated twice on the double numbering wheel. The actuation mechanism comprises again one actuation pawl 2* for actuating the numbering wheels 11 to 17, in the same manner as for conventional mechanical numbering boxes. FIG. 16B again illustrates the positions of the wheels of the numbering box of FIG. 16A while numbering the $100^{th}$, $101^{st}$, $200^{th}$, $201^{st}$, $300^{th}$ and $301^{st}$ sheets.

Simplified box configuration can also be designed to carry out numbering upwards. Expressed in mathematical terms, simplified numbering box configurations can be envisaged in both cases when:

(i) numbering is carried out downwards from a starting number Start# where the number formed by digits N to 1 is equal to $10^N-1$; or (ii) numbering is carried out upwards from a starting number Start# where the number formed by digits N to 1 is equal to 0.

In such cases, the predetermined sequence of digit pairs includes R distinct digit pairs DP calculated with the formula:

$$DP=DP_{START}+\alpha*[(r-1)*k*n+((i-1)*n+(j-1))],$$

where $DP_{START}$ is the digit pair formed of digits N+2 and N+1 of the starting number Start#, and R designates the number of runs r (or layer cycle) after which the sequence of digit pairs DP repeats itself and is given by the formula:

$$R=LCM(k*n;100)/k*n.$$

Similarly, the previous numbering box configurations discussed with reference to the exemplary embodiment of FIG. 8 is required when:

(i) numbering is carried out downwards from a starting number Start# where the number formed by digits N to 1 is different from $10^N-1$; or (ii) numbering is carried out upwards from a starting number Start# where the number formed by digits N to 1 is different from 0.

In such cases, the predetermined sequence of digit pairs includes 2*R distinct digit pairs DP1 and DP2 calculated with the formulas:

$$DP1=DP_{START}+\alpha*[(r-1)*k*n+((i-1)*n+(j-1))],$$

$$DP2=DP1+\alpha.$$

In any of the above described embodiments, further processing of the numbered sheets occurs as follows:

(i) after having been numbered according to the above numbering principle, the consecutively-numbered sheets of each run are piled so as to form consecutive piles of $10^N$ substrates numbered in sequence; and (ii) the piles are processed to form P packs of individual security documents numbered in sequence, each individual security document bearing one security print.

Processing of the piles includes (i) cutting each pile along the rows and columns so as to form k*n individual bundles of $10^N$ security documents numbered in sequence, and (ii) assembling B successive bundles to form the P packs of security documents numbered in sequence. Prior to formation of the packs, each bundle may furthermore advantageously be banded.

It will be understood that various modifications and/or improvements obvious to the person skilled in the art can be made to the embodiments described hereinabove without departing from the scope of the invention defined by the annexed claims.

The invention claimed is:

1. A process for numbering substrates having security prints printed thereon, each of said substrates comprising a plurality of security prints which are arranged in k columns and n rows on the substrate, wherein product k*n is an integer multiple of ten or of twenty-five, said process comprising the step of numbering successive runs of $10^N$ substrates each, by providing each of the security prints with a serial number Serial#, the serial number Serial# being calculated with the formula:

$$Serial\#=Start\#+\alpha*[(r-1)*k*n*10^N+((i-1)*n+(j-1))*10^N+MOD(s-1;10^N)],$$

where Start# is a starting number from which numbering starts, α is equal to −1 or +1 depending on whether numbering is carried out downwards or, respectively upwards, r identifies the run of $10^N$ successive substrates, i and j respectively identify the column and the row on the substrate where the security print to be numbered is located, s is a number which identifies the substrate onto which the security print to be numbered is located and MOD(x; y) designates the so-called modulus function which returns the integer remainder of the division of y by x, wherein digits N+2 and N+1 of the serial number Serial# are produced by sequential actuation of a double numbering wheel bearing a predetermined sequence of digit pairs for digits N+2 and N+1.

2. The process as defined in claim 1, wherein:

numbering is carried out downwards from a starting number Start# where the number formed by digits N to 1 is different from $10^N-1$; or (ii) numbering is carried out upwards from a starting number Start# where the number formed by digits N to 1 is different from 0, said predetermined sequence of digit pairs including 2*R distinct digit pairs DP1 and DP2 calculated with the formulas:

$$DP1=DP_{START}+\alpha*[(r-1)*k*n+((i-1)*n+(j-1))],$$

$$DP2=DP1+\alpha.$$

where $DP_{START}$ is the digit pair formed of digits N+2 and N+1 of the starting number Start#, and R designating the number of runs r after which the sequence of digit pairs DP1, DP2 repeats itself and is given by the formula:

$$R=LCM(k*n;100)/k*n.$$

where LCM(x; y) designates the so-called least common multiple function which returns the lowest common multiple of x and y.

3. The process as defined in claim 1, wherein:

(i) numbering is carried out downwards from a starting number Start# where the number formed by digits N to 1 is equal to $10^N-1$; or (ii) numbering is carried out upwards from a starting number Start# where the number formed by digits N to 1 is equal to 0, said predetermined sequence of digit pairs including R distinct digit pairs DP calculated with the formula:

$$DP=DP_{START}+\alpha*[(r-1)*k*n+((i-1)*n+(j-1))],$$

where $DP_{START}$ is the digit pair formed of digits N+2 and N+1 of the starting number Start#, and R designates the number of runs r after which the sequence of digit pairs DP repeats itself and is given by the formula:

$$R=LCM(k*n;100)/k*n.$$

where LCM(x; y) designates the so-called least common multiple function which returns the lowest common multiple of x and y.

4. The process as defined in claim 1, wherein each run r includes hundred successive substrates.

5. A method for processing substrates in the form of sheets or repetitive lengths of webs, each of said substrates including security prints arranged in k columns and n rows, wherein product k*n is an integer multiple of ten or of twenty-five, said method comprising the following steps:

numbering successive runs of $10^N$ substrates each according to the numbering process of any one of claims 1 to 4;

piling the successively numbered substrates of each run so as to form successive piles of $10^N$ substrates numbered in sequence;

cutting each pile along the rows and columns so as to form k*n individual bundles of $10^N$ security documents numbered in sequence, each individual security document bearing one security print; and assembling B successive bundles to form P packs of individual security documents numbered in sequence.

6. The method as defined in claim 5, further comprising the step of banding each bundle of security documents prior to formation of the packs.

7. A numbering box for typographic numbering of substrates in sheet-fed or web-fed printing machines, each of said substrates including security prints arranged in k columns and n rows, product k*n being an integer multiple of ten or of twenty-five, wherein said numbering box is adapted to apply serial numbers Serial# comprising d digits onto a determined location on each substrate, the serial number being given by the following formula:

$$Serial\#=Start\#+\alpha*[(r-1)*k*n*10^N+((i-1)*n+(j-1))*10^N+MOD(s-1;10^N)],$$

where Start# is a starting number from which numbering starts, α is equal to −1 or +1 depending on whether numbering is carried out downwards or, respectively upwards, r identifies a run of $10^N$ successive substrates, i and j respectively identify the column and the row on the substrate where the security print to be numbered is located, s is a number which identifies the substrate onto which the security print to be numbered is located and MOD(x; y) designates the so-called modulus function which returns the integer remainder of the division of y by x, and wherein the numbering box includes d−1 numbering wheels, comprising N numbering wheels for digits 1 to N, a double numbering wheel for digits N+2 and N+1 which bears a predetermined sequence of digit pairs, and d−N−2 numbering wheels for digits N+3 to d.

8. The numbering box as defined in claim 7, comprising mechanical actuation means for sequential actuation of said numbering wheels.

9. The numbering box as defined in claim 7, wherein said double numbering wheel is formed of two numbering wheels fixedly secured to one another.

10. The numbering box as defined in claim 7, adapted to carry out the numbering process according to claim 3, wherein the numbering wheels for digits 1 to N−1 and the numbering wheels for digits N+3 to d are ten-segment numbering wheels bearing the sequence of numerals "0" to "9", and wherein the numbering wheel for digit N is an eleven-segment numbering wheel bearing the sequence of numerals "0" to "9" with two consecutive "0" numerals.

11. The numbering box as defined in claim 7, adapted to carry out the numbering process according to claim 4, wherein the numbering wheels for digits 1 to N and the numbering wheels for digits N+3 to d are ten-segment numbering wheels.

12. The numbering box as defined in claim 7, wherein the said determined sequence of digit pairs is repeated m times on the double numbering wheel, m being an integer comprised between 1 and 10.

13. The numbering box as defined in claim 12, wherein the double numbering wheel is an eight-segment, a ten-segment or a twelve-segment numbering wheel.

* * * * *

UNITED STATES PATENT AND TRADEMARK OFFICE

CERTIFICATE OF CORRECTION

PATENT NO. : 7,975,906 B2
APPLICATION NO. : 11/921534
DATED : July 12, 2011
INVENTOR(S) : Johannes Georg Schade et al.

It is certified that error appears in the above-identified patent and that said Letters Patent is hereby corrected as shown below:

Column 16, line 40, "(Starts)" should be replaced by -- Start# --
Column 18, line 47, "numbering" should be replaced by -- (i) numbering --

Signed and Sealed this
Eighteenth Day of October, 2011

David J. Kappos

David J. Kappos
*Director of the United States Patent and Trademark Office*